US011066884B2

(12) United States Patent
Moyes

(10) Patent No.: US 11,066,884 B2
(45) Date of Patent: Jul. 20, 2021

(54) DOWNHOLE TOOL

(71) Applicant: XTREME WELL TECHNOLOGY LIMITED, Banchory (GB)

(72) Inventor: Peter Moyes, Banchory (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 321 days.

(21) Appl. No.: 15/035,912

(22) PCT Filed: Nov. 11, 2014

(86) PCT No.: PCT/GB2014/053347

§ 371 (c)(1),
(2) Date: May 11, 2016

(87) PCT Pub. No.: WO2015/067972

PCT Pub. Date: May 14, 2015

(65) Prior Publication Data

US 2016/0273289 A1 Sep. 22, 2016

(30) Foreign Application Priority Data

Nov. 11, 2013 (GB) ..... 1319883

(51) Int. Cl.
*E21B 23/06* (2006.01)
*E21B 23/01* (2006.01)
(Continued)

(52) U.S. Cl.
CPC ..... *E21B 23/01* (2013.01); *E21B 23/006* (2013.01); *E21B 23/04* (2013.01); *E21B 23/06* (2013.01); *E21B 33/128* (2013.01); *E21B 34/12* (2013.01)

(58) Field of Classification Search
CPC ..... E21B 23/01; E21B 23/006; E21B 23/06; E21B 34/12; E21B 33/128
See application file for complete search history.

(56) References Cited

U.S. PATENT DOCUMENTS 3,398,795 A 8/1968 Elliston
3,519,075 A * 7/1970 Mullins ..... E21B 34/125 166/150

(Continued)

FOREIGN PATENT DOCUMENTS

EP 0143572 A2 6/1985
GB 2432607 A 5/2007
WO 2005045181 A1 5/2005

OTHER PUBLICATIONS

International Search Report and Written Opinion issued in the related PCT Application PCT/GB2014/053347, dated Jul. 13, 2015 (11 pages).

(Continued)

*Primary Examiner* — Cathleen R Hutchins
*Assistant Examiner* — Ronald R Runyan
(74) *Attorney, Agent, or Firm* — Eileen Pape

(57) ABSTRACT

The invention provides a downhole initiator tool (10, 210, 410, 610) for use in initiating a downhole operation, and a method of use. The downhole initiator tool comprises a mandrel (34, 234, 434, 634), an initiator assembly (26, 226, 426, 626), and an anchor assembly (28, 228, 428, 628) mounted on the mandrel. The anchor assembly comprises a radially extendable anchor member (26, 226, 426, 626) for engaging an outer bore structure. The anchor assembly and the mandrel are axially moveable relative to each other in a first axial direction to sequentially extend the anchor member and activate the initiator assembly.

25 Claims, 11 Drawing Sheets

(51) Int. Cl.

| | |
|---|---|
| ***E21B 23/00*** | (2006.01) |
| ***E21B 33/128*** | (2006.01) |
| ***E21B 23/04*** | (2006.01) |
| ***E21B 34/12*** | (2006.01) |

(56) References Cited

U.S. PATENT DOCUMENTS

| | | | | |
|---|---|---|---|---|
| 4,049,055 | A * | 9/1977 | Brown | E21B 23/06 166/120 |
| 4,125,013 | A * | 11/1978 | Nicolas | E21B 23/01 73/152.56 |
| 5,366,010 | A | 11/1994 | Zwart | |
| 6,311,778 | B1 * | 11/2001 | Carisella | E21B 23/01 166/214 |
| 6,318,461 | B1 * | 11/2001 | Carisella | E21B 33/1216 166/135 |
| 6,651,747 | B2 * | 11/2003 | Chen | E21B 23/01 166/212 |
| 8,136,588 | B2 * | 3/2012 | Manson | E21B 23/006 166/123 |
| 2006/0272828 | A1 | 12/2006 | Manson | |
| 2009/0283279 | A1 * | 11/2009 | Patel | E21B 23/06 166/382 |

OTHER PUBLICATIONS

International Preliminary Report on Patentability issued in the related PCT Application PCT/GB2014/053347, dated May 17, 2016 (8 pages).

Office Action issued in the related EP Application 14815789.4, dated Oct. 12, 2018 (3 pages).

Examination Report issued in the related AU Application 2014345366, dated Nov. 3, 2017 (4 pages).

Combined Search and Examination Report issued in the related GB Application 1420082.8, dated Apr. 1, 2015 (5 pages).

Examination Report issued in the related GB Application 1612571.8, dated Jan. 7, 2020 (3 pages).

Examination Report issued in the related AU Application 2018256646 dated Jan. 3, 2020 (3 pages).

Examination Report issued in the CA Application 2930351 dated Jan. 21, 2021 (4 pages).

* cited by examiner 10
14
16
20
24
26
28
30
32
34
36
38
56
58
68
80
84
130

DOWNHOLE TOOL

FIELD OF THE INVENTION

The present invention relates to a downhole tool, and in particular to a downhole initiator tool for use in initiating a downhole operation.

BACKGROUND TO THE INVENTION

In the oil and gas industry tools are typically deployed into the wellbore, from surface, to provide some kind of operation. In many cases such tools will require some form of actuation. Actuation may be achieved by an on-board device, which may be activated when required, such as the electronic actuation of a motor or the like, for example via electrical signals delivered from surface.

In some cases actuation of a downhole tool may be provided by a separate, dedicated actuator tool. Further, in some cases it may be desirable to provide actuation of a downhole tool using simple mechanical manipulations, for example via a tubing string, wireline or the like. However, in some instances it may be difficult to reliably permit simple mechanical manipulations to be used to establish a necessary actuation event.

SUMMARY OF THE INVENTION

It is amongst the aims and objects of aspects of the invention to provide a downhole initiator tool and a method of use which addresses one or more drawbacks of prior art downhole initiator tools. It is amongst the aims and objects of aspects of the invention to provide a downhole initiator tool which is an alternative to presently available downhole initiator tools. Further aims and objects of the invention will be apparent from the following description.

An aspect of the present invention relates to a downhole initiator tool for use in initiating a downhole operation, comprising:

a mandrel;

an initiator assembly; and an anchor assembly mounted on the mandrel and comprising a radially extendable anchor member for engaging an outer bore structure, wherein the anchor assembly and the mandrel are axially moveable relative to each other in a first axial direction to sequentially extend the anchor member and activate the initiator assembly.

The anchor assembly and the mandrel may be axially moveable relative to each other in a first axial direction to sequentially and consecutively extend the anchor member and activate the initiator assembly.

Thus, relative movement between the anchor assembly and the mandrel in the same first axial direction causes the anchor member to be extended, and the initiator assembly to be subsequently activated. When activated, the initiator assembly may initiate a downhole operation. Any suitable or required downhole operation may be initiated, such as operation or actuation of a further downhole tool, system or the like.

As such, a common and uni-directional manipulation of the downhole tool may facilitate operation, specifically sequential operation, of both the anchor assembly and the initiator assembly. This may permit simplification of the downhole tool to be achieved, in that the requirement for multi-directional manipulation of the tool to operate both the anchor assembly and the initiator assembly may be minimised. Further, such an arrangement may increase flexibility in terms of deployment possibilities, such as readily allowing deployment and operation by, for example, wireline media and the like.

When the downhole initiator tool is positioned within a bore, manipulation of the tool to establish relative movement between the anchor assembly and the mandrel in the first axial direction may permit the anchor member to be extended and provide an anchor against an outer bore structure. Such an anchor may be provided within an open hole bore and/or a cased or lined bore. Such an anchor may be provided within or against a profile formed within an outer bore structure. The anchor may be achieved by radial gripping of the anchor member against an outer bore structure. For example, the anchor member may radially grip a bore wall. Alternatively, or additionally, the anchor may be achieved by interaction between the anchor member and a profile formed on or within the outer bore structure.

The creation of an anchor via the anchor assembly may facilitate the subsequent activation and/or operation of the initiator assembly during further relative movement between the anchor assembly and the mandrel in the same first axial direction. In some embodiments, the subsequent activation of the initiator assembly may not be possible or permitted until an anchor has been created.

The anchor established by the anchor member may provide a mechanical reaction point which may be used to support the subsequent activation of the initiator assembly. For example, the anchor established by the anchor member may provide a mechanical reaction point to permit further relative axial movement of the anchor assembly and the mandrel in the first axial direction to cause activation of the initiator assembly. In some embodiments relative movement between the anchor assembly and the mandrel to achieve activation of the initiator assembly may only be permitted after the anchor member has created an anchor.

The anchor assembly and the mandrel may be axially moveable relative to each other in the first axial direction over a first relative axial distance to cause the anchor member to be extended. The anchor assembly and the mandrel may be axially moveable relative to each other in the same first axial direction over a subsequent second relative axial distance to cause activation of the initiator assembly. The first and second relative axial distances may be consecutive with each other.

The anchor assembly and the mandrel may be axially moveable relative to each other in the first axial direction in a first relative movement action to cause the anchor member to be extended. The anchor assembly and the mandrel may be axially moveable relative to each other in the same first axial direction in a second relative movement action to cause activation of the initiator assembly. As such, relative movement between the anchor assembly and the mandrel in the first axial direction may cause the anchor member to be extended, with subsequent relative movement in the same first axial direction causing activation of the initiator assembly.

The first and second movement actions may be sequential.

In some embodiments the first and second movement actions may be continuous with each other. The first and second movement actions may be consecutive. For example, the first and second movement actions may be achieved by a continuous or consecutive manipulation of the downhole tool to effect relative axial movement between the anchor assembly and the mandrel in the first axial direction. In some embodiments the creation of an anchor by the anchor member may define a limit or the end of a first movement action. In such a case a second movement action to provide for activation of the initiator assembly may commence or be permitted following creation of the anchor.

In some embodiments the first and second movement actions may be separated by an intermediate movement action. Such an intermediate movement action may comprise relative movement of the anchor assembly and the mandrel, for example in the first axial direction. The intermediate movement action may provide or facilitate a further operation, for example a further operation within the downhole initiator tool and/or a separate tool or system.

The first movement action may include relative axial movement over a first axial distance. The second movement action may include relative axial movement over a second axial distance. The first and second relative axial distances may be consecutive to each other. The first and second relative axial distances may be defined in the first direction.

The anchor assembly and the mandrel may be axially moveable relative to each other in the first axial direction to sequentially extend and retract the anchor member. When the downhole tool is positioned within a bore, such operation of the tool may permit the anchor member to provide a temporary anchor against a wall of the bore during relative axial movement between the anchor assembly and the mandrel.

Accordingly, relative axial movement between the mandrel and the anchor assembly in the common first axial direction may cause the anchor member to be extended and subsequently retracted, and the initiator assembly to be actuated. Such multiple events may therefore be provided during uni-directional operation of the downhole tool.

In some embodiments the anchor member may be retracted, or be permitted to be retracted, following activation of the initiator assembly. In use, the anchor member may be utilised to provide an anchor which is present during activation of the initiation assembly. In such an arrangement the anchor assembly and the mandrel may be axially moveable relative to each other in the first axial direction to provide a temporary anchor, and activate the initiator assembly while the temporary anchor is in place or established.

In some embodiments release/retraction of the anchor member following activation of the initiation assembly may prevent or minimise the risk of the anchor member from interfering with any subsequent process or operation initiated by the initiator assembly.

The anchor member may be retracted or be permitted to be retracted during the second movement action. As such, this common second movement action may both activate the initiator assembly and cause or permit the anchor member to be retracted. The anchor member may be retracted or be permitted to be retracted at the end of the second movement action, for example immediately at the end of the second movement action. In one embodiment, the initiator assembly may be activated during the second movement action, and the anchor member may be retracted or be permitted to be retracted at the end of the second movement action.

In some embodiments the anchor assembly and the mandrel may be axially moveable relative to each other in the first axial direction in a third relative movement action to cause the anchor member to be retracted. The third relative movement action may be subsequent to the second relative movement action. The third movement action may be consecutive with the second movement action. In some embodiments an intermediate movement action may be provided between the second and third movement actions.

In some embodiments the anchor assembly and the mandrel may be axially moveable relative to each other in a preliminary movement action. The preliminary movement action may be prior to the first movement action. The downhole tool may be arranged such that the preliminary movement action and the first movement action are sequential, for example consecutive, with each other.

The preliminary movement action may comprise a single relative movement between the anchor assembly and the mandrel. Alternatively, the preliminary movement action may comprise multiple movements, for example a sequence of movements.

The preliminary movement action may comprise relative axial movement between the anchor assembly and the mandrel. Such relative axial movement may comprise relative movement in the first axial direction. Such relative axial movement may comprise relative movement in a second axial direction. The second axial direction may be opposite to the first axial direction.

The preliminary movement action may comprise relative axial movement between the anchor assembly and the mandrel over a preliminary axial distance.

The preliminary movement action may comprise a sequence of relative movements between the anchor assembly and the mandrel.

In one embodiment the preliminary movement action may comprise movement in both the first axial direction and a second axial direction. For example, the preliminary movement action may comprise reciprocal relative movement between the anchor assembly and the mandrel in the first and second axial directions.

The preliminary movement action may provide or facilitate a further operation, for example a further operation within the downhole initiator tool and/or a separate tool or system.

The downhole initiator tool may be configured such that relative movement between the anchor assembly and the mandrel in or during the preliminary movement action may be achieved without causing operation of one or both of the anchor assembly and the initiator assembly. Such an arrangement may permit a degree of free movement between the anchor assembly and the mandrel without necessarily operating the anchor member and/or initiator assembly. This may provide a number of advantages, such as permitting the downhole tool to be manipulated while being deployed in a wellbore without necessarily actuating the anchor assembly and/or the initiator assembly.

The downhole initiator tool may be configurable in an inactive state in which relative movement between the anchor assembly and the mandrel in the first movement action is prevented. Accordingly, extension of the anchor member, and thus subsequent operation of the initiator assembly may not be permitted when the tool is configured in its inactive state. Such an arrangement may assist to prevent or minimise the risk of premature actuation of the anchor assembly and/or initiator assembly. The downhole initiator tool may be configurable in its inactive state at least during deployment of said tool into a wellbore.

The downhole initiator tool may be configurable from the inactive state to an active state in which relative movement between the anchor assembly and the mandrel in at least the first movement action is permitted. As such, only when the tool is configured in its active state will the first relative movement action be permitted.

The downhole initiator tool may be configurable from the inactive state to the active state by relative movement between the anchor assembly and the mandrel in a preliminary movement action. The preliminary movement action may be as described above.

The preliminary movement action may comprise a sequence of relative movements between the anchor assembly and the mandrel. The sequence of relative movements may comprise a sequence of relative axial and/or rotational movement between the anchor assembly and the mandrel. The sequence of relative movement may comprise a defined sequence of relative movement. As such, in some embodiments the tool must be manipulated during the preliminary movement action to perform the defined sequence of relative movement before the first movement action is permitted. The requirement to perform such a predefined sequence of relative movement may minimise the possibility of inadvertent or premature activation of the anchor assembly and/or the initiator assembly. Further, any movement during the preliminary movement action may be utilised to perform a further or separate operation, prior to activation of the anchor assembly and/or the initiator assembly.

The downhole initiator tool may comprise an indexing arrangement associated with the mandrel and the anchor assembly. The indexing arrangement may be provided between the mandrel and the anchor assembly. The indexing arrangement may provide a connection between the mandrel and the anchor assembly.

The indexing arrangement may be configured to limit relative movement between the anchor assembly and the mandrel. The indexing arrangement may be configured to permit relative movement between the mandrel and anchor assembly in a preliminary movement action. For example, the indexing arrangement may be configured to permit or require a predefined relative movement to be performed between the mandrel and the anchor assembly before a first movement action can be performed to cause the anchor member of the anchor assembly to be extended.

The indexing arrangement may comprise a J-slot arrangement.

The indexing assembly may comprise a first indexing portion associated with one of the mandrel and anchor assembly and comprising an indexing track, and a second indexing portion associated with the other of the mandrel and the anchor assembly and comprising a track follower to be received and move within the indexing track. Relative movement between the first and second indexing portions may cause the track follower to move or index along the track. Accordingly, the permitted relative movement between the mandrel and the anchor assembly may be dictated by at least the form of the indexing track within which the track follower is located.

The track follower may comprise a pin.

The track may define a circumferentially extending track.

The track may define at least one axial limit region which functions to limit relative axial movement between the first and second indexing portions. The track may define at least one release region configured to permit relative axial movement of the first and second indexing portions beyond the limit provided by the axial limit region. Thus, the track follower may index along the track to first be limited at the limit region, and subsequently, during one or more further indexing steps, to be aligned and received within the release region. When the track follower is received within the release region of the track sufficient relative axial movement between the anchor assembly and the mandrel may be permitted to cause extension of the anchor member. For example, when the track follower is received within the release region of the track the anchor assembly and the mandrel may be axially moveable in a first relative movement action.

Relative axial movement between the mandrel and anchor assembly may cause relative rotational movement between the first and second indexing portions. Such relative axial and rotational movement may advance the track follower along the track.

In one embodiment one of the first and second indexing portions may be rotatably fixed relative to one of the mandrel and the anchor assembly, and the other of the first and second indexing portions may be rotatably mounted relative to the other of the mandrel and the anchor assembly. Such an arrangement may permit one of the first and second indexing portions to rotate and permit the track follower to progress along the track. By one of the first and second indexing portions being rotatably mounted on one of the mandrel and the anchor assembly, the relative rotation between the indexing portions may be achieved without also requiring rotation of either the anchor assembly and the mandrel. This may provide advantages in terms or minimising or eliminating the requirement to rotate the entire mandrel or the anchor assembly to achieve indexing.

In one embodiment the first indexing portion may be mounted on the mandrel. In some embodiments the first indexing portion may form part of the mandrel. For example, the indexing track may be formed in an outer surface of the mandrel.

In one embodiment the second indexing portion may be mounted relative to the anchor assembly, for example mounted on or forming part of the anchor assembly. In one embodiment the second indexing portion may be rotatably mounted relative to the anchor assembly, for example rotatably mounted on the anchor assembly.

In some embodiments both the anchor assembly and the mandrel may be moveable to provide relative movement therebetween.

In some embodiments the mandrel may be configured to remain substantially stationary such that the anchor assembly may be moveable relative to said mandrel.

In some embodiments the anchor assembly may be configured to remain substantially stationary such that the mandrel may be moveable relative to said anchor assembly.

In some embodiments the downhole initiator tool may comprise a provisional anchor assembly associated with the anchor assembly. The provisional anchor assembly may be connected with the anchor assembly. The provisional anchor assembly may form part of the anchor assembly. The provisional anchor assembly may be arranged to provide a provisional anchor against an outer bore structure, such as a bore wall, and effectively permit the anchor assembly to be substantially held stationary relative to the outer bore structure such that the mandrel may be moved relative to the anchor assembly.

The provisional anchor may comprise a friction anchor assembly. The friction anchor assembly may be configured to frictionally engage an outer bore structure. Such frictional engagement may permit the mandrel to be moved while the anchor assembly is held, or substantially held, relative to the outer bore structure. In some instances the frictional holding force achieved by the provisional anchor may be sufficient to permit relative movement between the anchor assembly and the mandrel to extend the anchor member. However, in some cases the holding force may be insufficient to permit relative movement to activate the initiator assembly. In such an instance, the provision of an anchor once the anchor member has been extended may provide a necessary additional holding force to permit further relative movement between the mandrel and the anchor assembly to be achieved to activate the initiator assembly.

The provisional anchor assembly may comprise at least one anchor element configured to engage an outer bore structure, such as a bore wall, when the tool is located within a bore. At least one anchor element may comprise an elongate element configured to extend radially outwardly from the tool to engage an outer bore structure. At least one anchor element may comprise a bowed elongate element, such as a bow spring elongate element. In some embodiments a plurality of anchor elements may be provided.

The provisional anchor assembly may comprise a sleeve member mounted on the mandrel, wherein one or more anchor elements are mounted on the sleeve member. The sleeve member may be connected, for example threadedly connected, to the anchor assembly.

In use, the downhole initiator tool may be deployed into a wellbore in a downhole direction. The downhole tool may be pulled in an uphole direction, with an upward force being applied to the mandrel. With the provisional anchor acting against the outer bore structure, for example by frictional engagement, the upward force applied to the mandrel may cause the mandrel to move relative to the anchor assembly, to eventually cause the anchor member to be extended to engage the outer bore structure, with further upward pulling on the mandrel causing activation of the initiator assembly.

The anchor assembly may comprise a sleeve structure mounted on the mandrel. The anchor assembly may comprise a sleeve member slidably mounted on the mandrel, wherein the anchor member is connected to said sleeve member. In such an arrangement relative movement between the mandrel and the sleeve member may cause corresponding relative movement of the anchor member.

The anchor member may be connected to one end of the sleeve member. In some embodiments the sleeve member may define at least one castellation or slot configured to receive the anchor member. The sleeve member and the anchor member may be connected via a clevis-type connection.

The anchor member may be posited intermediate opposing ends of the sleeve member. For example, the anchor member may extend radially through the sleeve member at a position which is intermediate opposing ends of said sleeve member. In one embodiment the sleeve member may comprise or define a radial slot configured to accommodate the anchor member therein. The arrangement may be such that the anchor member may be permitted to move radially within the slot.

The anchor member may be pivotally mounted to the sleeve member. In such an arrangement pivoting motion of the anchor member may permit the anchor member to be extended and retracted. The anchor member may be pivotally mounted via a pin member. Such a pin member may be removable to permit removal of the anchor member. The pin member may extend laterally relative to a central axis of the sleeve member. The pin member may be inserted laterally into the sleeve member from an external surface thereof. The pin member may be threadedly secured to the sleeve member.

The anchor member may be slidably mounted, for example radially slidably mounted, to or relative to the sleeve member. In such an arrangement radial sliding motion of the anchor member may permit the anchor member to be extended and retracted.

In one embodiment the anchor member may comprise a slip. Such a slip may, for example, be pivotally mounted within the anchor assembly, such as on a sleeve member of the anchor assembly.

In one embodiment the anchor member may comprise a toggle member or arrangement. The toggle member or arrangement may comprise a toggle anchor portion configured to be moved, for example pivoted, to be radially extended and retracted. The toggle member or arrangement may comprise a toggle activator, such as a toggle arm, connected to the toggle anchor, and configured to move the toggle anchor in response to an appropriate force applied to the anchor assembly.

In one embodiment the anchor member may comprise a dog. Such a dog may be arranged to be moved radially within the anchor assembly, for example radially within a radial slot formed in a sleeve member of the anchor assembly.

In some embodiments multiple forms of anchor member may be used.

The anchor assembly may comprise a no-go profile to limit relative movement between the anchor assembly and the mandrel in at least one axial direction. The no-go profile may limit relative movement in a second relative axial direction, which is opposite to the first relative axial direction. The no-go profile may comprise an annular shoulder configured to axially engage a corresponding annular shoulder provided on the mandrel.

The anchor assembly may comprise a biasing arrangement configured to bias the anchor member in a desired direction. The biasing arrangement may be configured to bias the anchor member towards a retracted position. The biasing arrangement may comprise a spring assembly. The biasing arrangement may comprise a pin assembly, such as a spring pin assembly, configured to act against the anchor member.

In one embodiment the biasing arrangement may provide a biasing force at a lateral offset from a pivot point of the anchor member, to apply a biasing turning moment on said anchor member.

The anchor member may comprise a gripping arrangement, such as a gripping surface configured to engage a bore wall. The gripping arrangement may comprise a profile configured to assist with gripping a bore wall, such as a serrated profile, knurled profile or the like. The gripping arrangement may be directly formed within or on the anchor member. In some embodiments the gripping arrangement may be provided within an insert which is mounted within the anchor member. Such an arrangement may facilitate replacement of the insert, for example to address wear of the insert, to accommodate a particular bore wall or the like.

The anchor member may comprise a profile configured to cooperate with a corresponding profile on an outer bore structure. In some embodiments the anchor member may define a profile configured to cooperate with a target profile on an outer bore structure.

The anchor assembly may comprise a plurality of anchor member. Each anchor member may be configured to be extended during relative movement between the anchor assembly and the mandrel in the first axial direction. The anchor members may be circumferentially arranged around the mandrel, for example evenly circumferentially arranged. In some embodiments at least three anchor members may be provided. Such an arrangement may facilitate a degree of centralising of the tool within a wellbore.

The mandrel may comprise an anchor member surface configured to support the anchor member during relative movement between the anchor assembly and the mandrel. The anchor member surface may comprise a planar surface. Such an arrangement may assist to rotatably lock the anchor assembly and the mandrel together.

The initiator assembly may comprise a hydraulic initiator assembly.

The initiator assembly may be configured, when activated, to establish fluid communication between a fluid source and a downhole system, to cause or facilitate actuation of said downhole system. The downhole system may comprise a portion of the downhole initiator tool, another downhole tool, or the like.

The fluid source may comprise a source of pressurised fluid.

The fluid source may comprise a fluid reservoir, such as a remote, for example surface located reservoir, on-board reservoir or the like.

The fluid source may comprise an ambient fluid source, such as a fluid source originating from a downhole environment in which the tool is positioned during use. Such an arrangement may permit use of downhole hydrostatic pressure within the wellbore. For example, the initiator assembly, when activated, may provide fluid/pressure communication between the wellbore environment and a downhole system, which may permit hydrostatic pressure within the wellbore environment to be utilised to actuate the downhole system.

The initiator assembly may comprise a valve or valve structure.

The initiator assembly may comprise a mechanical initiator assembly. For example, an arrangement of relatively sliding, for example axially and/or rotatably sliding, sleeves or the like, which may mechanically manipulate a downhole system, such as a connected tool, to provide for operation of such a tool.

The initiator assembly may comprise a clockwork mechanism, a timer mechanism, an explosive charge arrangement or the like.

The initiator assembly may comprise at least first and second components which are caused to move relative to each other, for example axially relative to each other, to activate the initiator assembly. In one embodiment a first component may be fixed, for example axially fixed, relative to the mandrel and a second component may be secured or fixed, at least temporarily, relative to the anchor assembly, such that relative movement between the anchor assembly and the mandrel may provide relative movement between the first and second components of the initiator assembly.

In one embodiment one of the first and second components of the initiator assembly may become fixed relative to the anchor assembly after the anchor member has been extended. In such an arrangement relative movement between the first and second components of the initiator assembly may only be permitted following extension of the anchor member and creation of an anchor with an outer bore structure.

The first and second components of the initiator assembly may be moveable relative to each other to open a fluid port, for example to establish communication with a fluid source.

The downhole initiator tool may comprise a deflector arrangement configured to permit deflection of the anchor member of the anchor assembly radially outwardly during relative movement between the anchor assembly and the mandrel, for example during the first relative movement step.

In some embodiments the deflector arrangement may be configured to become positioned between the anchor member and the mandrel during relative axial movement between the anchor assembly and mandrel in the first axial direction. Such an arrangement may be suitable to deflect an anchor member in the form of, for example a slip, dog or the like.

In some embodiments the deflector arrangement may be configured to provide a reaction surface against which the anchor member may engage and react to become radially extended during relative movement between the anchor assembly and the mandrel, for example during the first relative movement step. Such an arrangement may be suitable to cause deflection of an anchor member in the form of a toggle anchor member, for example.

The deflector arrangement may comprise a deflector member configured to facilitate deflection of the anchor member radially outwardly. The deflector arrangement may comprise a single deflector member, configured to deflect one or more anchor members. Alternatively, the deflector arrangement may comprise a plurality of deflector members each configured to deflect one or more anchor members. The deflector arrangement may comprise a corresponding number of deflector members as anchor members within the anchor assembly.

The deflector arrangement may comprise a wedge member. The deflector arrangement may comprise an annular structure. Such an annular structure may have a tapered or ramped end to facilitate ease of deflection of an anchor member. The deflector arrangement may comprise an annular shoulder.

The deflector arrangement may comprise a radial spring arrangement, such as a bowed spring arrangement. Such an arrangement may be configured to provide a radial bias to an anchor member when said anchor member is deflected outwardly. This may function to maintain a radial bias against an extended anchor member. Further, this may permit a degree of radially inward deflection of the anchor member to be achieved when said member is radially extended, for example to permit the anchor member to be deflected until suitable engagement with a desired anchor location, such as anchor profile is achieved.

The deflector arrangement may be mounted on the mandrel.

In some embodiments the deflector arrangement may be integrally formed on the mandrel. Accordingly, in such an arrangement any relative movement between the anchor assembly and the mandrel will provide corresponding movement between the anchor assembly and the deflector arrangement.

The deflector arrangement may be fixed, for example permanently fixed relative to the mandrel. In such an arrangement relative movement between the anchor assembly and the mandrel, for example during the first relative movement step, may permit the anchor member to eventually become aligned with the deflector arrangement to be deflected radially outwardly. Further, in some embodiments further or subsequent relative movement between the anchor assembly and the mandrel may permit the anchor member to eventually become misaligned with the deflector arrangement to be allowed to be moved radially inwardly.

In some embodiments the deflector arrangement may be secured or connected relative to the mandrel such that relative movement between the mandrel and the anchor assembly may provide corresponding relative movement between the anchor assembly and the deflector arrangement to cause the anchor member to be extended, for example to establish alignment between the anchor member and the deflector arrangement.

The deflector arrangement may be configured to be moveable relative to the mandrel to permit the anchor member of the anchor assembly to be retracted.

The deflector arrangement may be configurable from a first configuration in which the anchor member may be extended by the deflector arrangement during relative movement between the anchor assembly and the mandrel in the first axial direction, and a second configuration in which the anchor member may be retracted during further relative movement between the anchor assembly and the mandrel in the same first axial direction.

When in the first configuration the deflector arrangement may be positioned to deflect the anchor member radially outwardly and support said anchor member in the extended position. When in the second configuration the deflector arrangement may be moved or be reconfigured to de-support the anchor member and permit said anchor member to become retracted.

The deflector arrangement may be configurable between its first and second configurations by relative axial movement between the anchor assembly and the mandrel in the first axial direction. The deflector arrangement may be configurable between its first and second configurations by relative axial movement between the mandrel and the deflector arrangement in the first axial direction.

When in the first configuration the deflector arrangement may be located at a first position relative to the mandrel. When at this first position the deflector arrangement, for example a deflector member, may be supported by the mandrel in a position to deflect the anchor member of the anchor assembly radially outwardly.

When in the second configuration the deflector arrangement may be located at a second position relative to the mandrel. When at this second position at least a portion of the deflector arrangement, for example a deflector member, may be de-supported to permit the deflector arrangement to collapse relative to the mandrel and thus de-support the anchor member of the anchor assembly and permit this anchor member to be retracted.

The mandrel may comprise at least one mandrel pocket configured to receive at least a portion of the deflector arrangement, such as a deflector member, when the deflector arrangement is positioned at the second position relative to the mandrel. As such, when the deflector arrangement is located at the first position relative to the mandrel the deflector arrangement, such as a deflector member, may be misaligned with the mandrel pocket, and when the deflector arrangement is moved towards its second position relative to the mandrel the deflector arrangement, such as a deflector member, may become aligned with the mandrel pocket to be received therein and permit a previously extended and supported anchor member to be retracted.

The deflector arrangement may comprise a pivotally mounted deflector member, wherein the deflector member may pivot to be received within the mandrel pocket.

The downhole initiator tool may comprise a control assembly mounted on the mandrel.

The control assembly may be configured to permit, cause or facilitate the anchor member of the anchor assembly to be positioned within its extended position.

The control assembly may be configured to permit, cause or facilitate the anchor member of the anchor assembly to be retracted from an extended configuration. The control assembly may be configured to permit the anchor member of the anchor assembly to be retracted during or as a result of relative movement between the mandrel and the anchor assembly in the first axial direction, for example at the end of the second relative movement action.

In some embodiments the control assembly may comprise the deflector arrangement.

The control assembly may be arranged on the mandrel such that relative axial movement between the anchor assembly and the mandrel may provide corresponding relative axial movement between the anchor assembly and the control assembly.

In embodiments where the control assembly comprises the deflector arrangement the relative movement between the anchor assembly and the control assembly may establish engagement between the anchor member and the deflector arrangement and cause the anchor member to be extended.

In some embodiments the control assembly may define a movement limiter configured to limit relative movement between the anchor assembly and the mandrel at a position in which the anchor member is extended.

The control assembly may be configured to be moveable relative to the mandrel to permit the anchor member of the anchor assembly to be retracted. Such movement may remove any support to the anchor member to permit said anchor member to be retracted. Alternatively, or additionally, such movement may remove any movement limiter to permit the anchor assembly to be moved to a position in which the anchor member may be retracted.

The control assembly may be configurable from a first configuration in which the anchor member may be permitted to be extended, for example by a deflector arrangement, during relative movement between the anchor assembly and the mandrel in the first axial direction, and a second configuration in which the anchor member may be retracted during further relative movement between the anchor assembly and the mandrel in the same first axial direction.

When in the first configuration a deflector arrangement and the anchor assembly may be positioned relative to each other such that the anchor member is deflected radially outwardly and in the extended position. When in the second configuration the deflector arrangement and the anchor assembly may be positioned relative to each other such that the anchor member may be de-supported to become retracted.

The control assembly may be configurable between its first and second configurations by relative axial movement between the anchor assembly and the mandrel in the first axial direction. The control assembly may be configurable between its first and second configurations by relative axial movement between the mandrel and the control assembly in the first axial direction.

When in the first configuration the control assembly may be located at a first position relative to the mandrel. When at this first position a deflector arrangement carried or supported by the control assembly may be supported by the mandrel in a position to deflect the anchor member of the anchor assembly radially outwardly.

When in the second configuration the control assembly may be located at a second position relative to the mandrel. When at this second position a deflector arrangement carried or supported by the control assembly may be de-supported to permit at least a portion of the deflector arrangement to collapse relative to the mandrel and thus de-support the anchor member of the anchor assembly and permit this slip to be retracted.

The downhole initiator tool may comprise a releasable connection between the mandrel and the control assembly. The releasable connection may form part of the control assembly.

The releasable connection may be configured to provide a connection, for example an axial connection, between the mandrel and the control assembly to permit the control assembly to be moved with the mandrel relative to the anchor assembly to permit the anchor member to be extended.

The releasable connection may be configured to be released such that relative movement between the control assembly and the mandrel is permitted. Such an arrangement may allow the control assembly to permit retraction of the anchor assembly, for example by permitting a deflector arrangement to become aligned with a pocket on the mandrel, and/or to permit the anchor assembly to be moved to misalign the anchor assembly with a deflector arrangement.

The releasable connection may be configured to be released upon exposure to a predetermined force, typically a predetermined axial force, between the mandrel and the control assembly. That is, once exposed to the predetermined force the releasable connection may be released.

The releasable connection may comprise one or more frangible connectors extending between the mandrel and the control assembly, wherein the one or more connectors are arranged to break or fail upon exposure to the predetermined force. At least one frangible connector may comprise a shear pin, screw or the like.

The releasable connection may comprise a latch member extending between, for example laterally between, the control assembly and the mandrel. The latch member may be received within a latch recess formed in one of the mandrel and the control assembly, wherein when the latch member is received within said latch recess a connection between the control assembly and the mandrel may be provided.

The latch member may be releasable from the latch recess upon application of a predetermined force, for example an axial/shear force, between the mandrel and the control assembly.

The latch member may be laterally moveable relative to the control assembly and the mandrel to selectively provide and release the connection therebetween.

The latch recess and latch member may be configured to interact in an axial direction to permit the latch member to be displaced from the latch recess upon application of a predetermined force, typically an axial force, therebetween. The latch member and latch recess may be geometrically formed to permit an interaction therebetween to cause the latch member to be displaced from the latch recess upon exposure to a predetermined force therebetween.

The releasable connection may comprise a plurality of latch members. At least two latch members may be arranged circumferentially relative to each other. At least two latch members may be arranged axially relative to each other.

The releasable connection may comprise a single latch recess configured to receive a plurality of latch members. In some embodiments the releasable connection may comprise an annular recess. The releasable connection may comprise a plurality of latch recesses, wherein each latch recess may be configured to receive at least one latch member.

The latch member may comprise a rolling member. The latch member may comprise a ball, such as a ball bearing.

The releasable connection may comprise a latch biasing arrangement configured to bias the latch member in a direction, for example a lateral direction, to engage the latch recess and provide/maintain a connection. In such an arrangement the latch member must be moved against the bias of the latch biasing arrangement to be released from the latch recess. The latch biasing arrangement may comprise a spring biasing arrangement.

The latch biasing arrangement may comprise an axially moveable biasing member configured to engage the latch member, and bias said latch member in a desired direction, for example a lateral direction. The axially moveable biasing member may be biased in an axial direction. The axially moveable biasing member may be biased by one or more axial spring members.

The biasing member may comprise a tapered surface for engaging the latch member. Such a tapered surface may permit the biasing member to apply a lateral force against the latch member upon an axial force being applied to the biasing member. Such an arrangement may therefore permit an axially applied biasing force to act in a lateral direction on the latch member. This may permit a sufficient biasing force to be applied, without requiring any significant increase in the diameter of the tool.

The biasing member may comprise a sleeve member. Such a sleeve member may act on multiple latch members, for example circumferentially arranged latch members. An axial end face of the sleeve member may define a tapered surface for engaging the latch member. An opposing axial end face may be engaged by at least one biasing spring member.

A single spring member, such as a coil spring member, may engage the biasing member.

Alternatively, multiple spring members, such as coil spring members may engage the biasing member. In one embodiment a plurality of circumferentially arranged spring members, such as coil spring members, may engage the biasing member.

The releasable connection may comprise a release latch recess and a locking latch recess axially separated from each other and each configured to receive the latch member. Relative movement between the mandrel and the control assembly may permit the latch member to be displaced from the release latch recess and eventually received within the locking latch recess. When the latch member is received within the locking latch recess the control assembly and the mandrel may become locked together, preventing any return relative axial movement therebetween.

The locking latch recess may define a deeper recess than the release latch recess.

In one embodiment the mandrel may define a latch recess configured to receive a latch member. A latch recess may be provided in an outer surface of the mandrel. A biasing arrangement may be provided on the control assembly to bias a latch member into engagement with a latch recess provided on the mandrel The releasable connection may define an overpull mechanism, configured to become loaded and release a connection between the mandrel and the control assembly when a predefined axial force is applied therebetween.

The control assembly may be configured to facilitate activation of the initiator assembly. The control assembly may form part of the initiator assembly. In one embodiment the control assembly may comprise an initiator sleeve member configured to move relative to the mandrel to cause activation of the initiator assembly.

The mandrel may form part of the initiator assembly. The mandrel may comprise one or more ports which are initially sealed by the control assembly, such as an initiator sleeve member of the control assembly, wherein relative movement between the mandrel and the control assembly permits the one or more ports in the mandrel to be opened. Such opening of the ports may establish fluid or pressure communication with a fluid source. The mandrel may comprise an internal bore in communication with the one or more ports. In some embodiments the internal bore of the mandrel may be fluidly connected with a downhole tool or system, such that fluid communication with said downhole tool or system may be achieved.

The downhole initiator tool may comprise a connector for permitting connection to a further downhole tool or system. The connector may comprise a threaded connector or the like. The connector may be configured to provide a fluid connection between the initiator tool and a further downhole tool or system. Such a fluid connection may facilitate or accommodate a fluid based, for example hydraulic, initiation via the initiator assembly.

The connector may be configured to permit the initiator tool to deploy a further downhole tool or system into a wellbore. For example, the connection may be configured to be made up at surface, such that the further downhole tool or system may be deployed with the downhole initiator tool.

The connector may be configured to be established at a downhole location. Such an arrangement may permit the downhole initiator tool to be connected to and initiate operation of a further tool or system which is already located downhole.

The downhole initiator tool may comprise a first connector for permitting connection to a further downhole tool or system, and a second connector for permitting connection to a deployment arrangement. In such an arrangement, when connected to the second connector the deployment arrangement may be used to deploy the initiator tool into a wellbore, and optionally retrieve the initiator tool from the wellbore. In some embodiments the deployment arrangement may comprise an elongate deployment arrangement extending from surface. The deployment arrangement may comprise a tubing string, such as a coiled tubing string. The deployment arrangement may comprise wireline, slickline or the like.

The deployment arrangement may comprise a tractor assembly.

An aspect of the present invention relates to a method for downhole actuation of a downhole tool or system, comprising:

coupling an initiator tool to a downhole tool or system, wherein the initiator tool comprises a mandrel, an anchor assembly and an initiator assembly;

positioning the initiator tool in a wellbore;

establishing relative axial movement in a first axial direction between the anchor assembly and the mandrel to extend an anchor member of the anchor assembly into engagement with a bore structure;

establishing subsequent relative axial movement in the same first axial direction between the anchor assembly and the mandrel to cause activation of the initiator assembly to actuate the downhole tool or system.

The method may comprise coupling the downhole tool or system to the initiator tool prior to locating the initiator tool within a wellbore. In such an arrangement the downhole tool or system may be deployed simultaneously with the initiator tool.

In an alternative embodiment the method may comprise deploying the initiator tool into a wellbore and then coupling to the downhole tool or system at a downhole location.

The method may comprise causing the anchor member of the anchor assembly to be retracted following activation of the initiator assembly. The anchor member of the anchor assembly may retracted during or as a result of relative axial movement between the anchor assembly and the mandrel in the first axial direction.

The method according to this present aspect may be performed by use of a downhole initiator tool according to any other aspect. Features defined in relation to any other aspect may be considered to also be associated with the method according to this present aspect.

An aspect of the present invention relates to a downhole initiator tool for use in initiating a downhole operation, comprising:

a mandrel;

an initiator assembly; and an anchor assembly mounted on the mandrel and comprising a radially extendable anchor member for engaging an outer bore structure, wherein the anchor assembly and the mandrel are axially moveable relative to each other in a first axial direction to sequentially extend and retract the anchor member to establish a temporary anchor with an outer bore structure, and activate the initiator assembly while the temporary anchor is established.

An aspect of the present invention relates to a downhole tool, comprising:

a mandrel; and an anchor assembly mounted on the mandrel and comprising a radially extendable anchor member for engaging an outer bore structure, wherein the anchor assembly and the mandrel are axially moveable relative to each other in a first axial direction to sequentially extend and retract the anchor member to provide a temporary anchor with the outer bore structure.

An aspect of the present invention relates to a downhole tool, comprising:

a mandrel;

an anchor assembly mounted on the mandrel and being axially movable relative to the mandrel, wherein the anchor assembly comprises a radially extendable anchor member for engaging an outer bore structure; and a control assembly mounted on the mandrel and being configurable from a first position in which the control assembly radially extends the anchor member and a second configuration in which the anchor member is permitted to be retracted, wherein the control assembly is configured from the first position to the second position during relative movement between the anchor assembly and the mandrel.

An aspect of the present invention relates to a downhole tool, comprising:

a mandrel; and an anchor assembly mounted on the mandrel and comprising a radially extendable anchor member, wherein the anchor assembly is axially moveable relative to the mandrel in a first axial direction to cause the anchor member to be sequentially extended and retracted.

An aspect of the present invention relates to a downhole tool, comprising:

a mandrel;

a deflector member mounted on the mandrel, wherein the deflector member comprises a radial biasing member;

an anchor assembly mounted on the mandrel and comprising a radially extendable anchor member for engaging an outer bore structure, wherein the anchor assembly and the mandrel are axially moveable relative to each other in a first axial direction to establish alignment between the anchor member and the deflector member to extend the anchor member and activate the initiator assembly.

In such an arrangement the anchor member may become radially extended to engage a bore wall structure and thus define an anchor within the bore. Further, by providing a radial biasing member as a deflector member the anchor member may be radially biased towards an extended configuration.

In some embodiments the radial biasing member may permit the anchor member, when extended, to be deflected radially inwardly against the bias, for example to permit the anchor member, and the downhole tool, to be moved axially until such time as the anchor member may be located at a desired location within a wellbore. Such a desired location may be defined by a region which includes or defines a profile configured to match a profile provided on the anchor member.

An aspect of the present invention relates to a latch assembly for use in providing a latch or releasable connection between an inner structure and an outer structure. The latch assembly may be provided substantially in accordance with the releasable connection defined above.

The latch assembly may comprise an inner structure and an outer structure mounted on the inner structure.

The latch assembly may comprise a latch member mounted on one of the inner and outer structures and a latch recess formed in the other of the inner and outer structures. In a first configuration of the latch assembly the latch member may be received within the latch recess to provide a connection between the inner and outer structures. In a second configuration of the latch assembly the latch member may displaced from the latch recess to release the connection between the inner and outer structures.

The latch assembly may be reconfigured from its first configuration to its second configuration upon application of a predetermined axial force between the inner and outer structures.

The latch member may be laterally moveable selectively provide and release the connection.

The latch member and latch recess may be geometrically formed to permit an interaction therebetween to cause the latch member to be displaced from the latch recess upon exposure to a predetermined force therebetween.

The latch assembly may comprise a plurality of latch members. At least two latch members may be arranged circumferentially relative to each other. At least two latch members may be arranged axially relative to each other.

The latch assembly may comprise a single latch recess configured to receive a plurality of latch members. In some embodiments the latch assembly may comprise an annular recess. The latch assembly may comprise a plurality of latch recesses, wherein each latch recess may be configured to receive at least one latch member.

The latch member may comprise a rolling member. The latch member may comprise a ball, such as a ball bearing.

The latch assembly may comprise a latch biasing arrangement configured to bias the latch member in a direction, for example a lateral direction, to engage the latch recess and provide/maintain a connection. In such an arrangement the latch member must be moved against the bias of the latch biasing arrangement to be released from the latch recess. The latch biasing arrangement may comprise a spring biasing arrangement.

The latch biasing arrangement may comprise an axially moveable biasing member configured to engage the latch member, and bias said latch member in a desired direction, for example a lateral direction. The axially moveable biasing member may be biased in an axial direction. The axially moveable biasing member may be biased by one or more axial spring members.

The biasing member may comprise a tapered surface for engaging the latch member. Such a tapered surface may permit the biasing member to apply a lateral force against the latch member upon an axial force being applied to the biasing member. Such an arrangement may therefore permit an axially applied biasing force to act in a lateral direction on the latch member. This may permit a sufficient biasing force to be applied, without requiring any significant increase in the diameter of the assembly.

The biasing member may comprise a sleeve member. Such a sleeve member may act on multiple latch members, for example circumferentially arranged latch members. An axial end face of the sleeve member may define a tapered surface for engaging the latch member. An opposing axial end face may be engaged by at least one biasing spring member.

A single spring member, such as a coil spring member, may engage the biasing member.

Alternatively, multiple spring members, such as coil spring members may engage the biasing member. In one embodiment a plurality of circumferentially arranged spring members, such as coil spring members, may engage the biasing member.

The latch assembly may comprise a release latch recess and a locking latch recess axially separated from each other and each configured to receive the latch member. Relative movement between the inner and outer structures may permit the latch member to be displaced from the release latch recess and eventually received within the locking latch recess. When the latch member is received within the locking latch recess the inner and outer structures may become locked together, preventing any return relative axial movement therebetween.

The locking latch recess may define a deeper recess than the release latch recess.

The latch assembly may define an overpull mechanism, configured to become loaded and release a connection between the inner and outer structures when a predefined axial force is applied therebetween.

An aspect of the present invention relates to an indexing apparatus configured to facilitate indexing between first and second components.

The indexing apparatus may be configured to limit relative movement between the first and second components. The indexing apparatus may be configured to limit relative movement between the first and second components to a predefined or restricted relative movement action.

The indexing apparatus may comprise a J-slot arrangement.

The indexing apparatus may comprise a first indexing portion associated with one of the first and second components, wherein the first indexing portion comprises an indexing track.

The indexing apparatus may comprise a second indexing portion associated with the other of the first and second components, wherein the second indexing portion comprises a track follower to be received and move within the indexing track of the first indexing portion. Relative movement between the first and second indexing portions may cause the track follower to move or index along track. Accordingly, the permitted relative movement between the first and second components may be dictated by at least the form of the indexing track within which the track follower is located.

The track follower may comprise a pin.

The track may define a circumferentially extending track.

The track may define at least one axial limit region which functions to limit relative axial movement between the first and second indexing portions. The track may define at least one release region configured to permit relative axial movement of the first and second indexing portions beyond the limit provided by the axial limit region. Thus, the track follower may index along the track to first be limited at the limit region, and subsequently, during one or more further indexing steps, to be aligned and received within the release region.

Relative axial movement between the first and second components may cause relative rotational movement between the first and second indexing portions. Such relative axial and rotational movement may advance the track follower along the track.

In one embodiment one of the first and second indexing portions may be rotatably fixed relative to one of the first and second components, and the other of the first and second indexing portions may be rotatably mounted relative to the other of the first and second components. Such an arrangement may permit one of the first and second indexing portions to rotate and permit the track follower to progress along the track. By one of the first and second indexing portions being rotatably mounted on one of the first and second components, the relative rotation between the indexing portions may be achieved without also requiring rotation of either the first and second components. This may provide advantages in terms or minimising or eliminating the requirement to rotate the entire first or second components to achieve indexing.

In one embodiment the first indexing portion may be mounted on the mandrel. In some embodiments the first indexing portion may form part of the mandrel. For example, the indexing track may be formed in an outer surface of the mandrel.

According to an aspect of the invention there is provided a downhole initiator tool substantially as described herein with reference to FIGS. 1A to 1C of the drawings.

According to an aspect of the invention there is provided a downhole initiator tool substantially as described herein with reference to FIGS. 2 to 8F of the drawings.

According to an aspect of the invention there is provided a downhole initiator tool substantially as described herein with reference to FIGS. 9A to 9C of the drawings.

According to an aspect of the invention there is provided a downhole initiator tool substantially as described herein with reference to FIGS. 10A to 10C of the drawings.

According to an aspect of the invention there is provided a downhole initiator tool substantially as described herein with reference to FIGS. 11A to 11D of the drawings.

It should be understood that features defined in relation to one aspect may be applied in combination with any other aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1A:
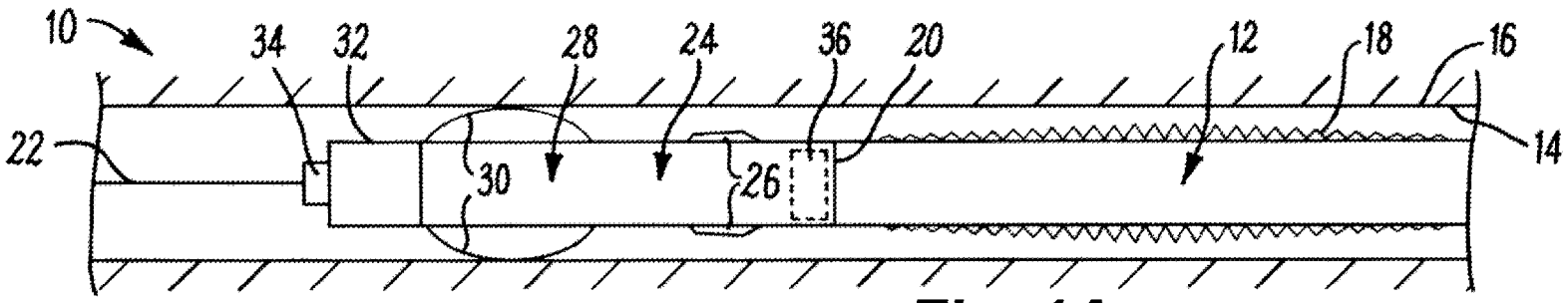
FIGS. 1A to 1C diagrammatically illustrate the sequential operation of a downhole tool assembly in accordance with an embodiment of the present invention.
Figure 1B:
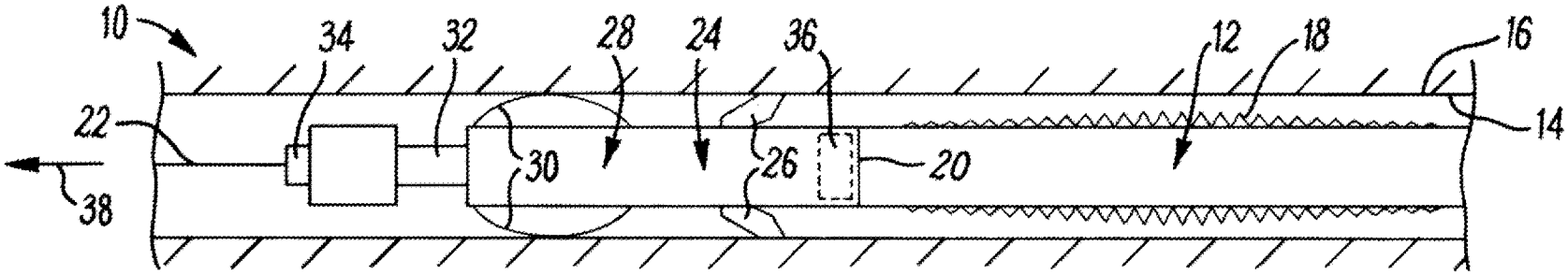
Figure 1C:
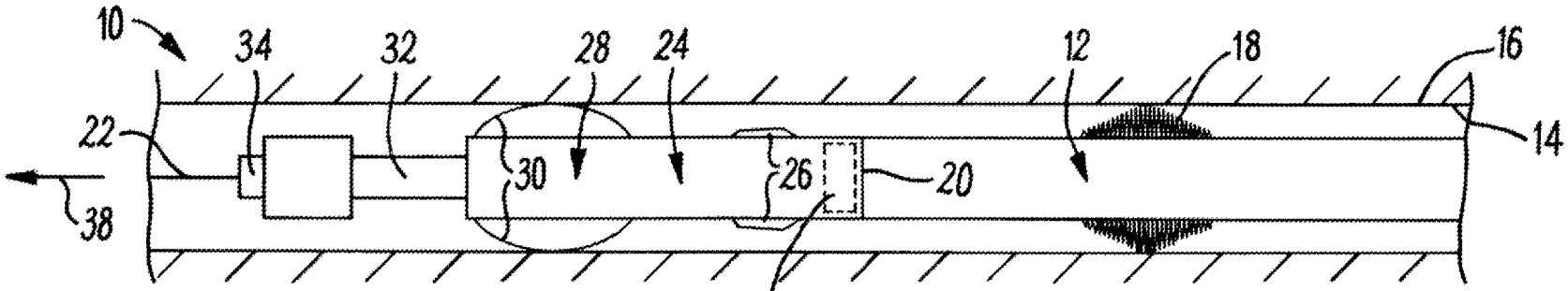

Aspects of the present invention relate to a downhole initiator tool which may be used in various downhole applications for actuating a downhole tool or system. An exemplary embodiment and use of a downhole initiator tool, generally identified by reference numeral 10, is shown in FIGS. 1A to 1C, which illustrate, diagrammatically, the sequential operation of the initiator tool 10 in actuating a sealing apparatus, generally identified by reference numeral 12. The sealing apparatus 12 may be of any suitable form and is configured to provide a seal against a wall 14 of a wellbore 16. The bore 16 may be an open hole or lined bore. In the example shown the sealing apparatus 12 includes a bellows or concertina sealing element 18 which is axially compressed and collapsed to become radially extended to engage the bore wall 14, as will be described in more detail below.

Referring initially to FIG. 1A, the sealing apparatus 12 is connected to the initiator tool 10 via a lower connector 20 on the tool 10, and both the initiator tool 10 and sealing apparatus 12 are deployed into the wellbore 16 on wireline 22. In some cases, for example in deviated wellbores, a wireline tractor may be utilised, although this is not shown for clarity purposes.

The initiator tool 10 includes an anchor assembly 24 which includes a plurality of circumferentially arranged anchor members 26. As will be described in more detail below, the anchor members 26 are operated to be radially extended into engagement with the bore wall 14 to provide a temporary anchor within the wellbore 16.

The initiator tool 10 includes a preliminary anchor assembly 28 which is coupled with and may be considered to form part of the anchor assembly 24. The preliminary anchor assembly 28 includes a number of circumferentially arranged bowed elements 30 which are configured to frictionally engage the bore wall 14.

The initiator tool 10 further includes a mandrel 32 upon which the anchor assembly 24 is mounted, wherein the mandrel 32 and anchor assembly 24 are moveable axially relative to each other. The mandrel carries an upper connector portion 34, such as a rope socket, which facilitates connection with the wireline 22.

The initiator tool 10 further includes an initiator assembly 36, shown in broken outline, which provides actuation of the connected sealing apparatus 12. Any suitable form of initiator assembly may be provided, to establish any suitable form of actuation for the sealing apparatus 12. However, in the present embodiment the initiator assembly 36 is configured to provide hydraulic actuation of the sealing apparatus 12. In particular, the initiator assembly 36, once activated, establishes fluid/pressure communication between the surrounding wellbore fluid with the sealing apparatus 12, permitting wellbore hydrostatic pressure to be used to activate the sealing element 18.

In use, the initiator tool 10 and seal assembly 12 may be deployed into the wellbore 16 to the required depth, as illustrated in FIG. 1A. Following this the mandrel 32 may be pulled via the wireline 22 in the direction of arrow 38, as shown in FIG. 1B. Due to the frictional engagement of the bowed elements 30 with the bore wall 14 the anchor assembly 24 is, to a large extent, held stationary within the wellbore 16, such that a first relative axial movement action is established between the mandrel 32 and the anchor assembly 24. This first relative movement action causes the anchor members 26 to become extended and engage the bore wall 14, providing an anchor within the wellbore 16.

The anchor achieved by the anchor members 26 provides a greater axial resistance than the preliminary anchor assembly 28, and permits the mandrel 32 to be subsequently moved further in the direction of arrow 38, to establish a second relative movement action between the mandrel 32 and the anchor assembly 24, as illustrated in FIG. 1C. Such second relative movement action permits the initiator assembly 36 to become activated, to cause the sealing element 18 of the sealing apparatus 12 to be axially compressed/collapsed and establish a seal against the bore wall 14. Once the initiator assembly 36 has been activated, the anchor members 26 become retracted. This may prevent the anchor members 26 and their anchoring function from interfering with the setting and operation of the sealing apparatus 12.

Accordingly, the initiator tool 10 may be configured to permit the anchor members 26 to be extended, the initiator assembly 36 to be activated, and the anchor members 26 to be subsequently retracted again, all in response to a single movement of the mandrel 32 in the common axial direction illustrated by arrow 38.

In FIGS. 1A to 1C the initiator tool 10 is illustrated in schematic form, to permit the basis of its operation to be briefly illustrated and described. However, various embodiments of the tool 10 are possible, and some exemplary embodiments will be described below with reference to FIGS. 2 to 11.

Figure 2:
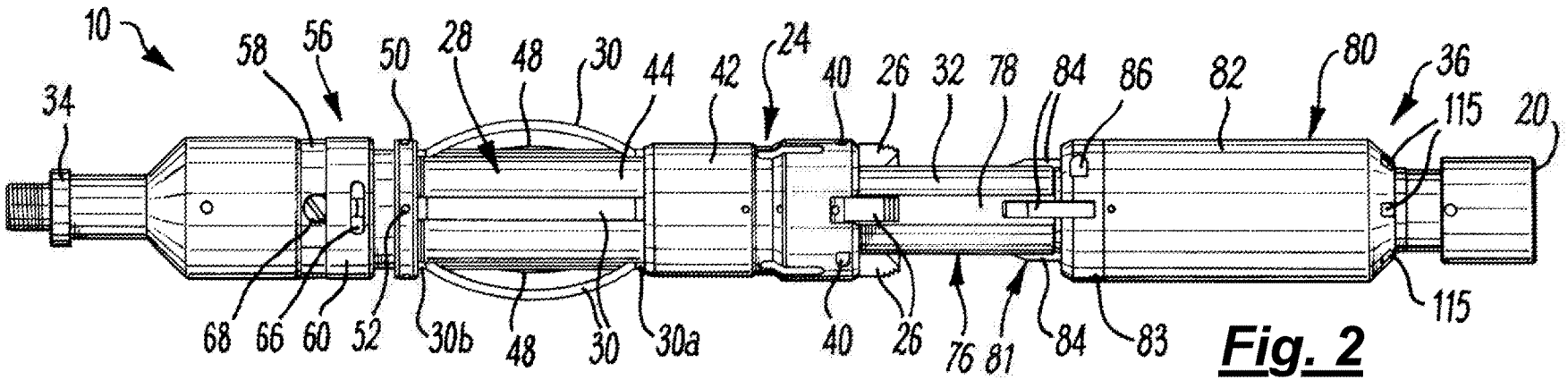
FIG. 2 illustrates a downhole initiator tool in accordance with an embodiment of the present invention.
Figure 3:
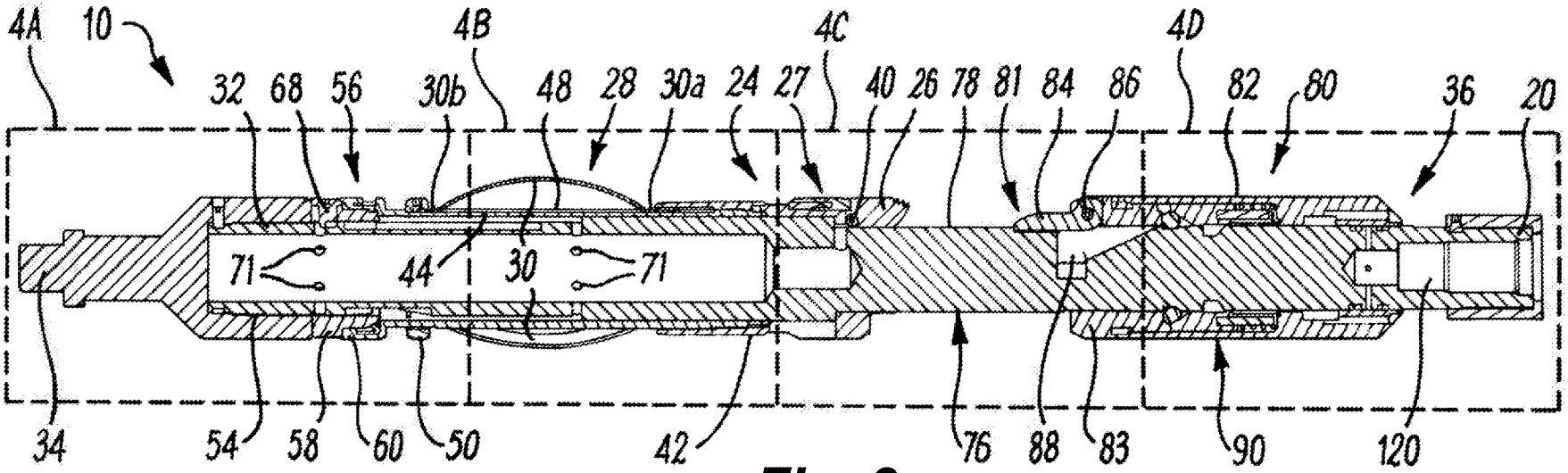
FIG. 3 is a longitudinal cross-sectional view of the tool of FIG. 2, taken along line 3-3.

Reference is initially made to FIG. 2, which illustrates an elevation view of a first embodiment of the tool 10, and FIG. 3 which provides a longitudinal cross-sectional view of the tool in FIG. 2, in combination with FIGS. 4A to 4D which provide enlarged views of regions 4A to 4D of FIG. 3 for clarity purposes.

As described above, the tool 10 includes a mandrel 32 upon which is mounted an anchor assembly 24. In the present embodiment shown the anchor assembly 24 is defined by a slip assembly (still identified by reference numeral 24), wherein the anchor members 26 are provided in the form of slips (still identified by reference numeral 26, and three in the embodiment shown) which are pivotally mounted via respective pin connections 40 to the lower end of a sleeve portion 42 of the slip assembly 24. Each slip 26 is provided in combination with a biasing arrangement 27, as most clearly illustrated in the larger view of FIG. 4C. Each biasing arrangement 27 includes a pin 29 which engages a rear face 31 of a respective slip 26, at an offset distance from the slip pivot axis defined by the pin connections 40. The pin 29 is acted on by a spring 33 in such a manner that a turning moment is created to bias the slips 26 to pivot towards their retracted positions.

Figure 4A:
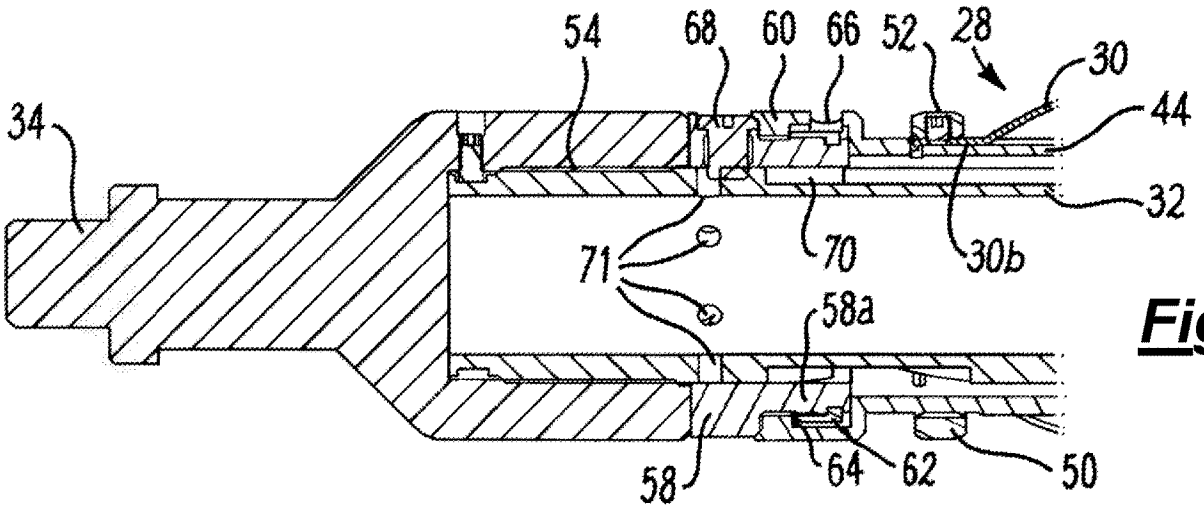
FIGS. 4A to 4D are enlarged views of the tool in FIG. 3, in regions 4A to 4D, respectively.
Figure 4B:
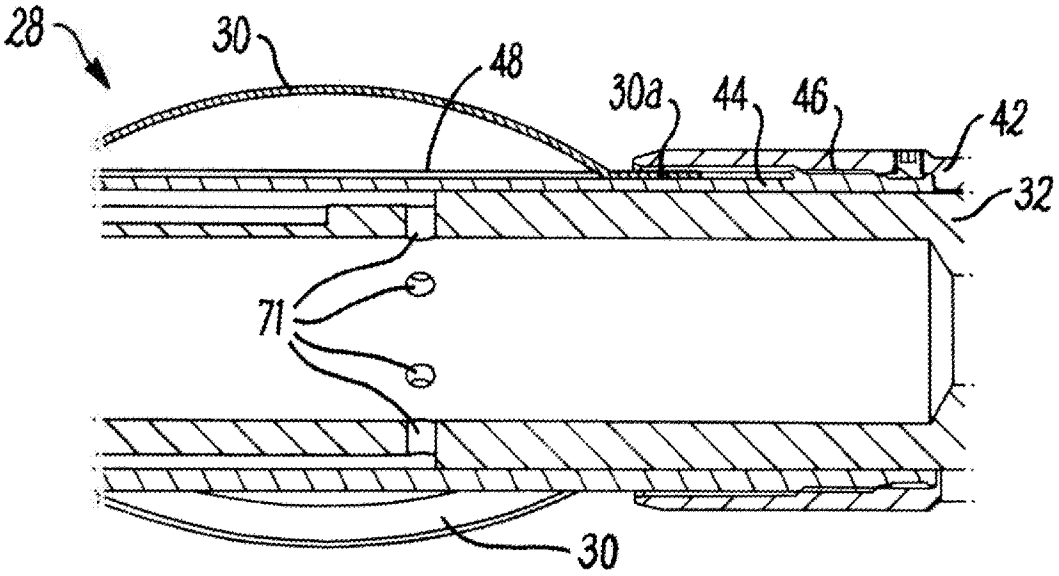

The slip assembly 24 includes the preliminary anchor assembly 28 which carries the bowed members 30. FIGS. 4A and 4B provide larger views of the preliminary anchor assembly 28. The preliminary anchor assembly 28 also includes a sleeve member 44 which is coupled, via a threaded connection 46, to the sleeve portion 42 of the slip assembly 24.

The sleeve member 44 of the preliminary anchor assembly 28 includes a number of circumferentially arranged and axially extending surface channels 48, wherein opposing ends 30*a*, 30*b* of each bowed member 30 are positioned within a respective channel 48. One end 30*a* of each bowed member 30 is radially disposed and retained between the sleeve portion 42 and sleeve member 44. The opposite end 30*b* of each bowed member 30 is radially secured relative to the sleeve member 44 via a threaded retaining ring 50, which is threadedly secured to the outer surface of the sleeve member 44. A number of grub screws 52 extend through the retaining ring 50 from an outer side thereof to engage the ends 30*b* of the individual bowed members 30 to ensure the members 30 are secured within the preliminary anchor assembly 28.

An upper end of the mandrel 32 is connected to the connector portion 34 which facilitates connection with wireline. Specifically, an upper end of the mandrel 32 includes a threaded portion 54 which is threadedly coupled to the connector portion 34.

A lower end of the mandrel 32 defines the lower connector 20 which facilitates connection with the sealing assembly 12 (FIG. 1).

The tool 10 further includes an indexing arrangement or mechanism 56, which provides a degree of relative movement control between the slip assembly 24 and the mandrel 32. As will be described in further detail below, the indexing arrangement 56 is configured to permit only a predetermined relative movement to be achieved between the slip assembly 24 and the mandrel 32.

The indexing arrangement 56, which can be seen in larger detail in FIG. 4A, comprises a rotatable follower component or ring 58 which is rotatably mounted within an upset end portion 60 of the sleeve member 44 of the preliminary anchor assembly 28. The rotatable follower 58 is mounted to the sleeve member 44 in such a way that the follower 58 is free to rotate relative to the sleeve member 44, and thus relative to the entire slip assembly 24, yet is axially fixed relative to the sleeve member 44 and slip assembly 24.

One axial end 58*a* of the follower 58 is received within the upset end 60 of the sleeve 44, and is axially retained via a latch ring 62, which may be a split ring, which has teeth for engaging complimentary teeth on the follower 58. The latch ring 62, once locked against the follower 58 via the complimentary teeth, axially secures the follower 58 to the sleeve 44, while permitting relative rotation therebetween, by engagement with an annular shoulder 64 provided on the upset end portion 60. The upset end portion 60 includes a window 66 which allows access to the latch ring 62 with an appropriate tool to permit this to be released to allow the follower 58 and the sleeve 44 to be separated.

The indexing arrangement 56 further includes a pin 68 which extends radially through the follower ring 58 and protrudes from a radially inner surface thereof. The pin 68, which is threadedly secured to the follower ring 58, is partially covered by the upset end 60 of the sleeve 44, which may prevent the pin 68 from being removed.

The pin 68 is engaged within an indexing track 70 formed within the outer surface of the mandrel 32. It should be noted that in FIGS. 3 and 4A the pin 68 appears to sit outside the track 70. However, it will be appreciated by those of skill in the art that the pin 68 sits outside the plane of the cross-section in FIGS. 3 and 4A, but has been included for the purposes of the present description.

Figure 5:
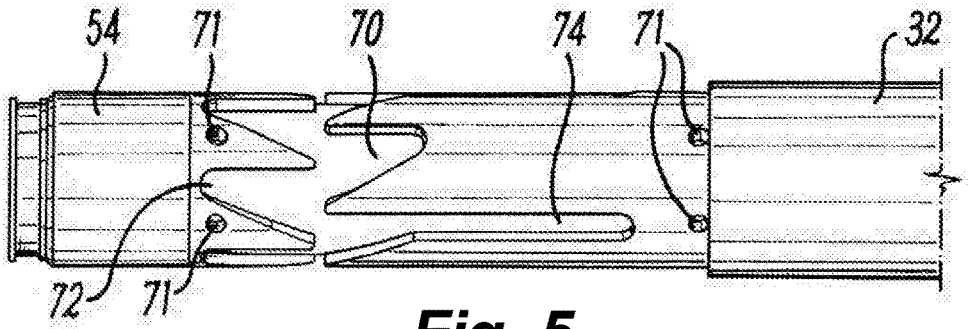
FIG. 5 is an enlarged view of an indexing portion provided on a mandrel of the tool first shown in FIG. 2.
Figure 6:
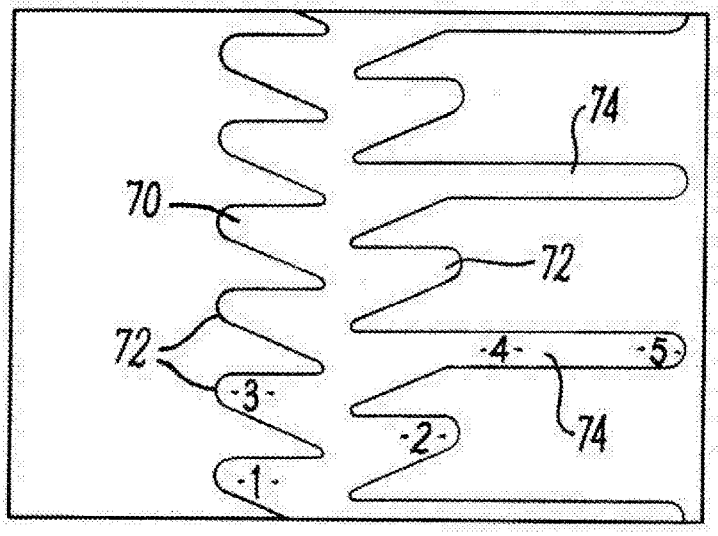
FIG. 6 illustrates the development of track of the indexing portion of FIG. 5 over a full 360 degrees.

An enlarged view of the mandrel 32 in the region of the track 70, with the slip assembly 24 removed, is illustrated in FIG. 5. In the embodiment shown the track 70 extends circumferentially around the mandrel 32 in a defined pattern. The development of the track over a full 360 degrees is illustrated in FIG. 6. The track includes short channel portions 72 and long channel portions 74.

When the mandrel 32 is moved axially relative to the slip assembly 24, the pin 68 will move within the track 70, progressing, or indexing, between the short and long channel portions 72, 74. During such relative movement the follower ring 58 will be caused to rotate. Without any relative rotation the pin 68 would not be able to progress along the track 70. It should be noted, however, that due to the rotatable connection between the follower ring 58 and the sleeve 44, and thus slip assembly 24, there is no requirement for either the mandrel 32 or the slip assembly 24 to be rotated at all. In this respect, the effect of the indexing arrangement 56 may be achieved while only requiring the smaller mass of the follower ring 58 to rotate, rather than the larger mass of either the slip assembly 24 and mandrel 32.

The mandrel 32 includes a number of ports 71 which assist to prevent any hydraulic lock occurring between the mandrel 32 and slip assembly 24.

The mandrel 32 includes a slip supporting region 76 which provides support to the slip members 26. Specifically, the slip supporting region 76 comprises a plurality of planar regions 78 which provide respective planar surfaces on which each slip 26 may be slidably mounted. Such an arrangement may cause the mandrel 32 and the slip assembly 24 to be rotatably fixed together.

Figure 4C:
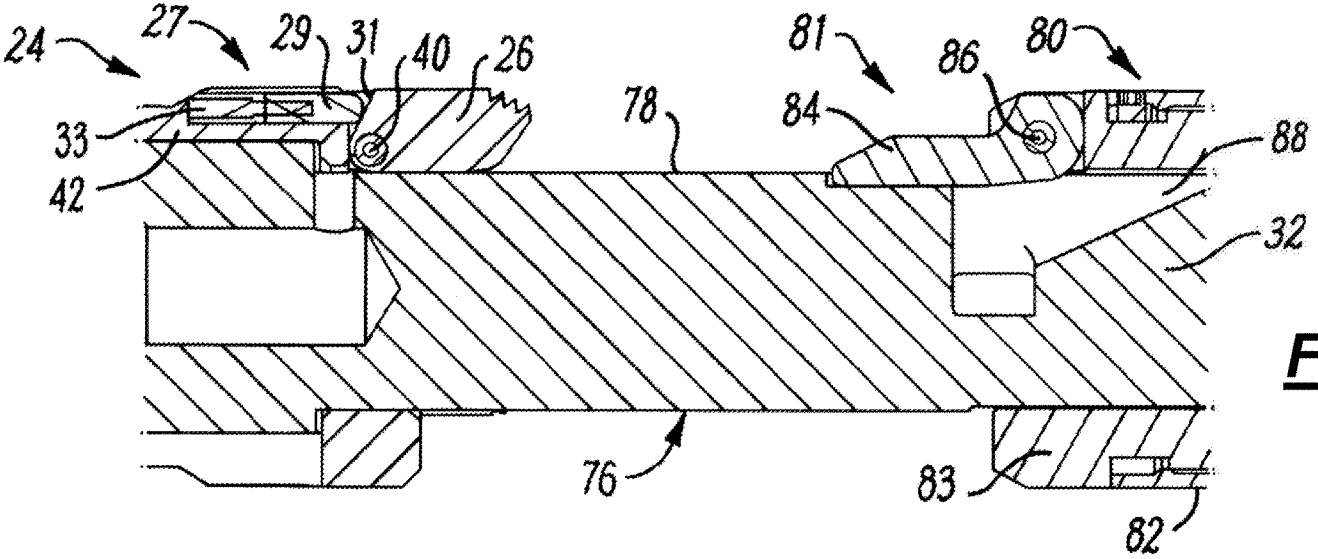
Figure 4D:
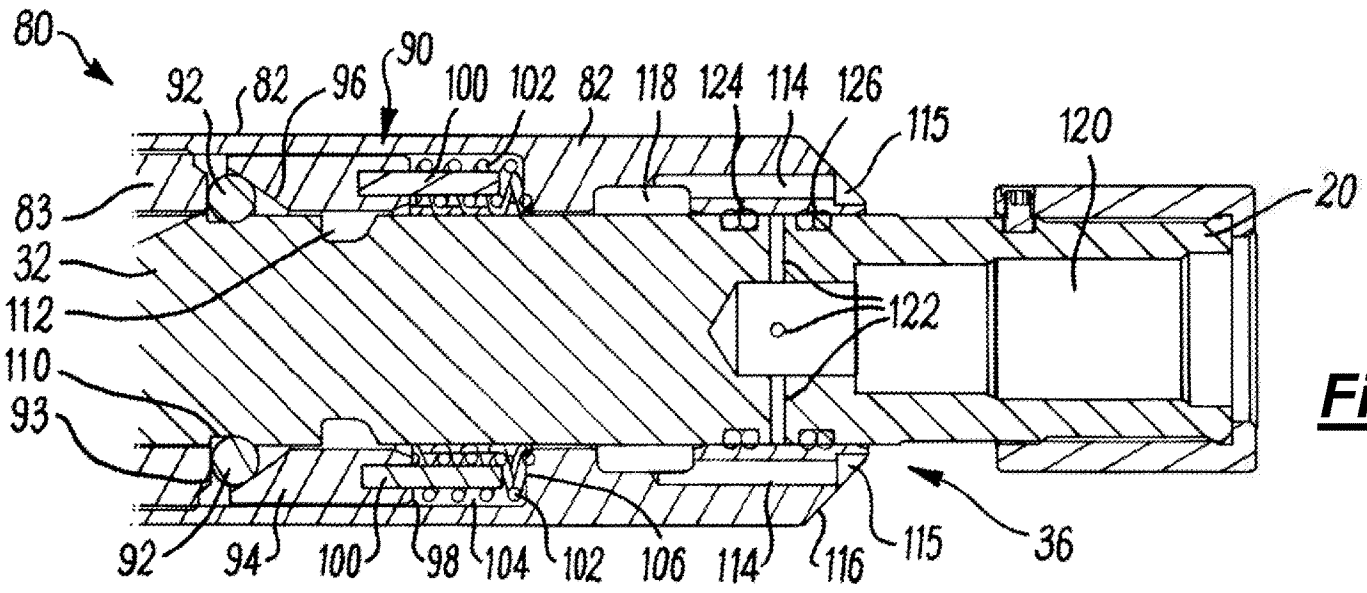

The tool 10 further comprises a control assembly 80 mounted on the mandrel 32, below the slip assembly 24, and initially axially separated from the slip assembly 24. The control assembly 80, which is shown in larger view in FIGS. 4C and 4D, is mounted on the mandrel 32 and includes a sleeve structure 82.

The tool 10 also includes a deflector arrangement 81 configured to permit deflection of the slips 26 of the slip assembly 24 radially outwardly during relative movement between the slip assembly 24 and the mandrel 32. In the embodiment shown the deflector arrangement 81 is mounted on, and may be considered to form part of, the control assembly 80, and comprises a plurality (three in the embodiment shown) of slip wedges 84 which are pivotally connected to the sleeve structure 82 via respective pin connections 86. Specifically, the slip wedges 84 are mounted on a wedge ring 83 which forms part of the sleeve structure 82.

The slip assembly 24 and the control assembly 80 (including the deflector arrangement 81) are mounted on the mandrel 32 such that the slips 26 and slip wedges 84 axially face each other, and are in axial alignment. As will be described in further detail below, relative axial movement between the slip assembly 24 and the control assembly 80, caused by movement of the mandrel 32 by a connected wireline, will cause the slips 24 to eventually engage and be deflected by the slip wedges 84, radially outwardly to engage a bore wall.

The mandrel 32 further includes a plurality of mandrel pockets 88, each one in circumferential alignment with a respective slip wedge 84. As will be described in further detail below, following relative axial movement between the mandrel 32 and the control assembly 80, the slip wedges 84 may pivot and drop into the respective mandrel pockets 88, to de-support an associated slip 26 when extended, allowing the slips 26 to become retracted.

Figure 7:
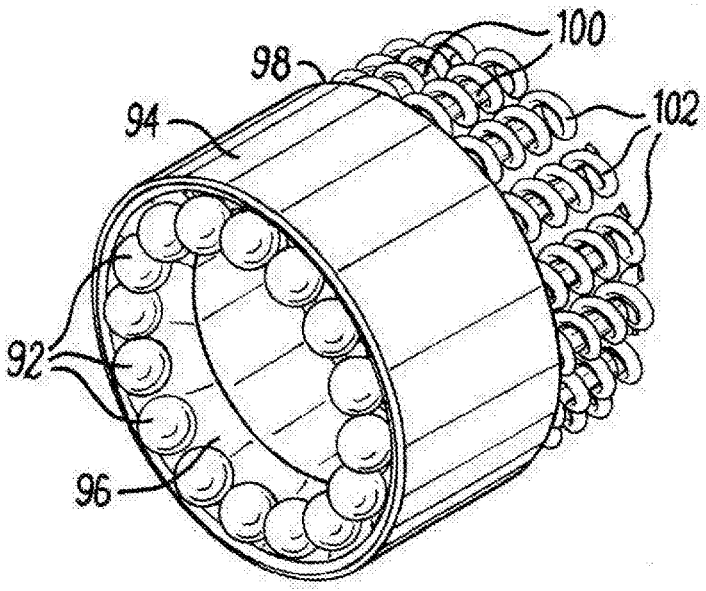
FIG. 7 is a perspective view of a portion of a releasable connection assembly, shown isolated from the tool of FIG. 2.

The control assembly 80 further comprises a releasable connection arrangement 90 (or latch assembly), which functions to provide a releasable connection between the mandrel 32 and the control assembly 80. The releasable connection arrangement 90, which is shown most clearly in the enlarged view of FIG. 4D, includes a plurality of balls 92, arranged circumferentially around the mandrel 32 at a common axial location. The connection arrangement 90 further comprises an biasing sleeve 94. One axial end 96 of the sleeve 94 is inwardly tapered, and engages the circumferential array of balls 92. A plurality of rods 100 extend from an opposite axial end 98 of the sleeve 94, wherein each rod caries a coil spring 102. FIG. 7 illustrates the assembly of the balls 92, sleeve 94, rods 100 and springs 102, removed from the tool 10. This assembly is located within an annular space 104 defined between the mandrel 32 and the sleeve structure 82 of the control assembly 80, wherein the balls 92 are axially engaged with an end face 93 of the wedge ring 83, and the springs 102 engage an annular shoulder 106 of the sleeve structure. The action of the springs 102 against the shoulder 106 biases the sleeve 94 axially, wherein the tapered surface 96, as a result, biases the balls 92 axially against the end face 93 of the wedge ring 83, and also radially inwardly against the mandrel 32.

The mandrel 32 includes a first annular groove 110 in an outer surface thereof which is arranged to receive the balls 92 when appropriate axial alignment therebetween is achieved, to provide a releasable connection between the control assembly 80 and the mandrel 92, as will be described in more detail below. The mandrel 92 further includes a second, deeper annular groove 112, axially spaced below the first annular groove 110, and also arranged to receive the balls when appropriate axial alignment therebetween is achieved, to provide a more permanent locking between the control assembly 80 and the mandrel 32, as will also be described in more detail below.

As noted above, the tool 10 includes an initiator assembly 36. In the present embodiment this initiator assembly 36 is defined by both the mandrel 32 and the control assembly 80. A larger view of the initiator assembly 36 is provided in FIG. 4D.

The sleeve assembly 82 of the control assembly 80 includes a number of bores 114 which extend axially between respective ports 115 formed in an axial end face 116 of the sleeve structure 82, and an annular chamber 118 defined between the sleeve structure 82 and the mandrel 32. Such an arrangement provides fluid communication of ambient wellbore fluid with the annular chamber 118.

The mandrel 32 includes a central bore 120 at its lower end which will be provided in fluid communication with the sealing apparatus 12 (FIG. 1) when connected therewith. A number of radial bores 122 extend from the central bore to an outer surface of the mandrel 32.

When the initiator assembly 36 is in its deactivated state, as shown in the larger view of FIG. 4D, the mandrel 32 and the control assembly 80 are axially positioned relative to each other such that the radial bores 122 are offset from the annular chamber 118, thus preventing any fluid communication therebetween. Seals 124, 126 are provided on either axial side of the bores 122 to assist with maintaining fluid isolation from the annular chamber 118. As will be described in further detail below, activation of the initiator assembly 36 is achieved by establishing relative axial movement between the mandrel 36 and the control assembly 80, such that the bores 122 become aligned with the annular chamber 118, and permit wellbore pressure to be communicated to a connected sealing apparatus 12 (FIG. 1), or indeed any other tool or system which may be connected to the initiator tool 10.

Reference is now made to FIGS. 8A to 8F which illustrate the sequential operation of the detailed illustrated initiator tool 10 within a wellbore 16. It should be noted that the tool 10 is illustrated in the sequential drawings of FIGS. 8A to 8F without connection to a further tool to be actuated, nor a wireline. This is intended to reflect that the initiator tool 10 could be used to actuate any downhole tool or system, and could be deployed into a wellbore 16 on any suitable deployment mechanism.

Figures 8A, 8B, 8C:
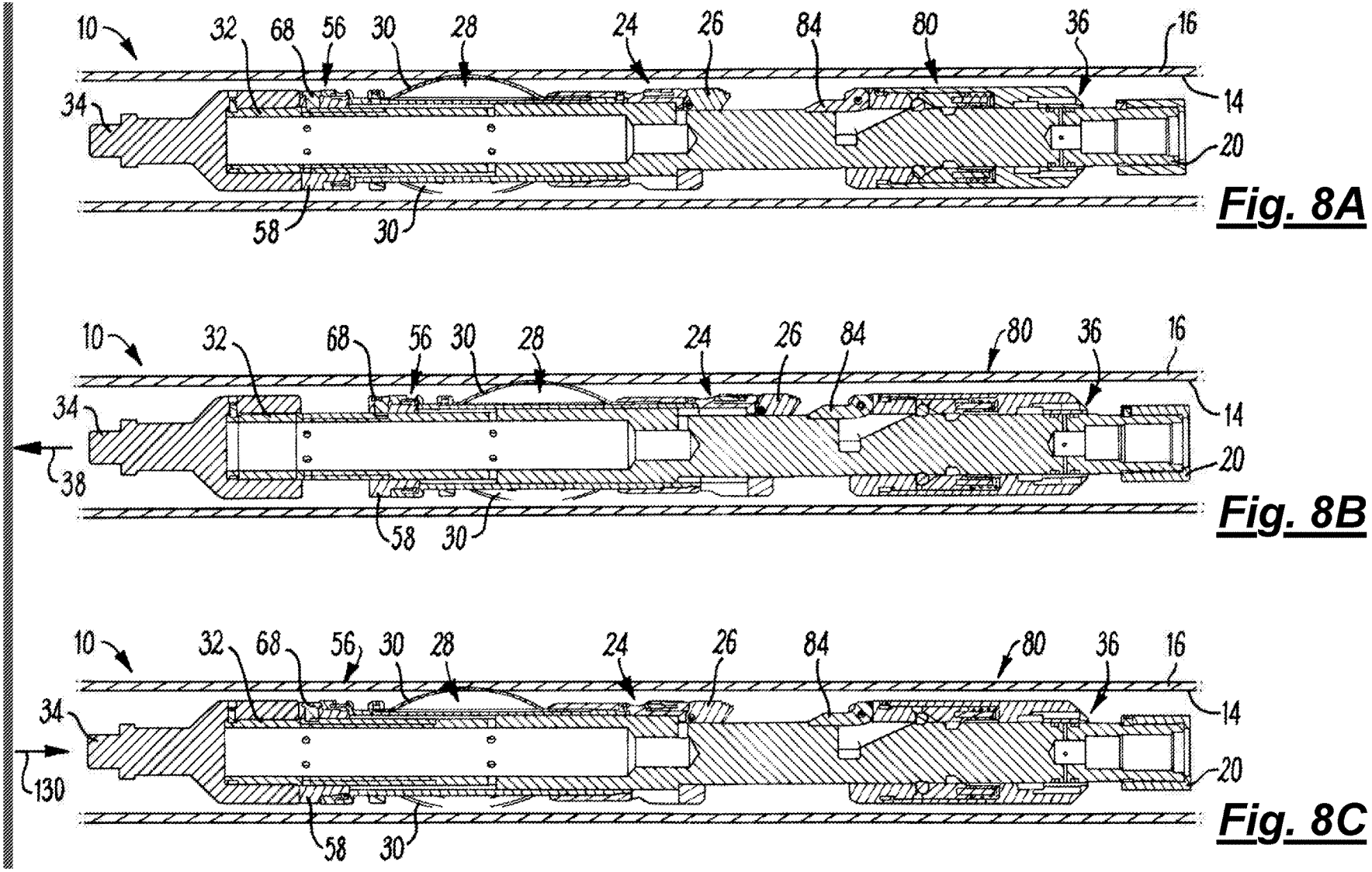
FIGS. 8A to 8F illustrate sequential stages of operation of the tool of FIG. 2.

The tool 10 is deployed into the wellbore 16 to the desired position, as illustrated in FIG. 8A, with the tool 10 in the configuration shown in FIGS. 2 to 4. While in this configuration the pin 68 of the indexing mechanism 56 is located at position "1" in the track 70, as illustrated in FIG. 6.

When at the desired location within the bore 16, the mandrel 32 is pulled upwardly, with the bowed elements 30 of the preliminary anchor assembly 28 frictionally engaging the bore wall 14 to provide a preliminary axial holding force of the slip assembly 24 relative to the bore wall 14, allowing the mandrel 32 to move axially in the direction of arrow 38 relative to the slip assembly 24. Such relative movement is permitted until the pin 68 of the indexing arrangement 56 becomes located at position "2" of the track 70 (FIG. 6). Such permitted initial relative movement is insufficient to extend the slips 26, as the slips 26 are still maintained at an axial separation distance from the slip wedges 84.

Following this the mandrel 32 may be set back down, in the direction of arrow 130, as shown in FIG. 8C, with the pin 68 of the indexing assembly 56 becoming located at position "3" within the track 70 (FIG. 6). It should be noted that during the progress, or indexing, of the pin 68 from position "1" to "3", the follower ring 58 is rotated, rather than either the mandrel 32 or the slip assembly 24.

It should be noted that this initial relative movement between the mandrel 32 and slip assembly 24, firstly in the direction of arrow 38 (FIG. 8B), and secondly in the direction of arrow 130 (FIG. 8C), may be considered to define a preliminary relative movement action, in that neither the slips 26 nor the initiator assembly 36 is activated. This preliminary relative movement action must be performed before the initiator tool 10 can be activated. The requirement or ability to perform the preliminary movement action may provide an operator with numerous advantages. For example, this may prevent an inadvertent activation of the initiator tool 10, for example due to an upward pull on the mandrel 32 being required for repositioning of the entire tool 10, for assisting in establishing depth correlation or the like.

Figure 8D:
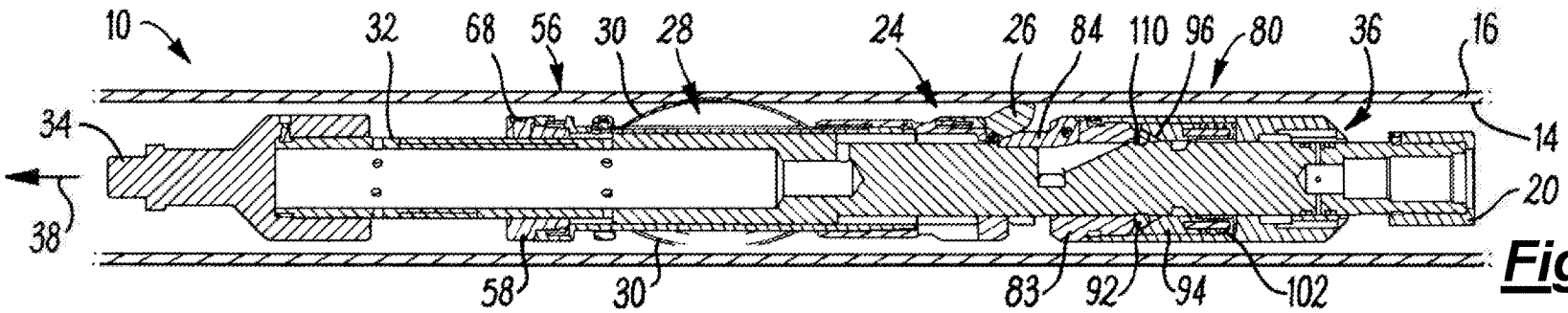

As illustrated in FIG. 8D, a subsequent upward pull on the mandrel 32 establishes a further relative axial movement between the mandrel 32 and the slip assembly 24, in the direction of arrow 38, in this case causing the pin 68 of the indexing assembly to enter the long channel portion 74 of the indexing track 70, as shown in FIG. 6. Accordingly, relative axial movement may be permitted beyond that previously achievable, allowing the slips 26 to engage and be deflected radially outwardly by the slip wedges 84 to establish an anchor against the bore wall 14. At this point the pin 68 of the indexing arrangement 56 is located at position "4" within the indexing track 70, as illustrated in FIG. 6. This movement to reposition the pin 68 from position "3" to "4" (FIG. 6) may be considered to be a first relative movement action.

Figure 8E:
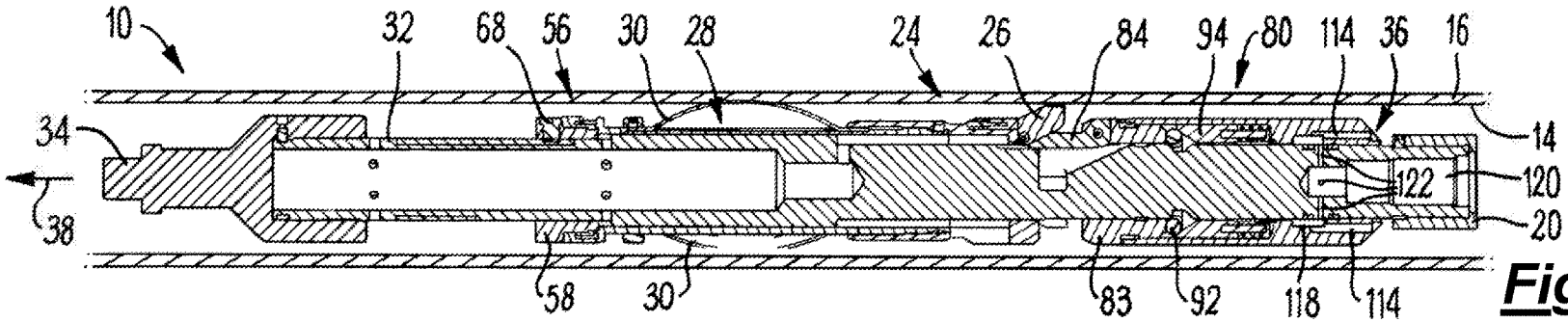
Figure 8F:
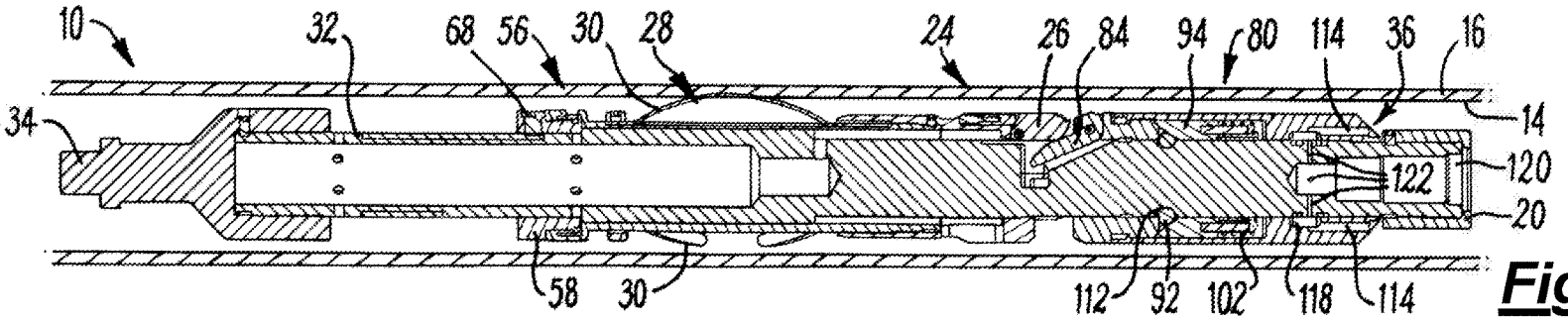

When the anchor is established, continued pulling on the mandrel 32 in the direction of arrow 38 will generate an increasing axial force against the control assembly 80, which will, ultimately, act against the balls 92 of the releasable connection arrangement 90 via the wedge ring 83. This will cause the balls 92 to be urged radially outwardly from the first recess 110 in the mandrel 32, thus axially loading the sleeve 94 via its tapered end face 96. When this axial load applied via the balls 92 exceeds the axial force in the opposite direction established by the springs 102, the balls 92 will become released from the first recess 110, releasing the axial connection between the control assembly 80 and the mandrel 32. Accordingly, the force of the springs may dictate the required axial force necessary to release the connection. When the connection is released, the mandrel 32 and the control assembly 80 may now be moveable axially relative to each other, as shown in FIG. 8E, such that the bores 122 of the mandrel 32 may become aligned with the annular chamber 118, establishing fluid communication between the surrounding wellbore fluid and mandrel bore 120, and thus activating the initiator assembly 36. At this point any connected tool or system may begin to be actuated.

Continued relative movement between the mandrel 32 and the slip assembly 24 may eventually cause the slip wedges 84 to become fully aligned with the mandrel pockets 88, allowing the slip wedges 84 to collapse into the pockets 88 and slips 26 to be retracted and release the anchor. At this point the pin 68 of the indexing arrangement 56 will be located at position "5" within the indexing track 70, as shown in FIG. 6. The relative movement between the mandrel 32 and the slip assembly 24 to reposition the pin 68 from position "4" to "5" may be considered to be a second relative movement action.

At the point when the slips 26 become retracted, the balls 92 of the releasable connection arrangement 90 become aligned and received within the second deeper annular groove 112. The depth of this groove 112 is such that the balls 92 cannot be radially displaced by an applied axial force, and as such the initiator tool 10 becomes locked-out.

An alternative embodiment of an initiator tool, identified by reference number 210, will now be described with reference to FIGS. 9A to 9C, which are sequential cross-sectional views of the tool 210 during operation. The tool 210 shares many similar features and functions in a very similar manner to the tool 10 first shown in FIG. 2, and as such like features share like reference numerals, incremented by 200. In view of the similarities between tool 210 and tool 10, only the principal differences will be highlighted.

In this case the tool 210 includes a mandrel 232 upon which is mounted an anchor assembly 224 which carries a number of anchor members 226. In this embodiment the anchor members 226 each comprise a toggle arrangement including a toggle anchor portion 226*a*, an activator arm portion 226*b* and a toggle ring 226*c*. One end of each toggle anchor portion 226*a* is pivotally mounted to a sleeve portion 242 of the anchor assembly 224. An opposite end of each toggle anchor portion 226*a* is pivotally connected to one end of a respective activator arm portion 226*b*. Each opposite end of the activator arm portions 226*b* are pivotally connected to the toggle ring 226*c*. As will be described in more detail below, upon application of an axial force against the toggle ring 226*c* the toggle anchor portion 226*a* is caused to be radially extended.

The tool 210 further comprises a preliminary anchor assembly 228 which is similar in form and function to anchor assembly 28 of tool 10, and as such no further detailed description will be given.

The tool 210 further comprises an upper connector portion 234 for facilitating connection to wireline, for example, and a lower connector portion 220 for facilitating connection to, for example, a tool to be initiated or operated by the initiator tool 210.

The tool 210 further comprises an indexing arrangement or mechanism 256 which is similar in form and function to the indexing arrangement 56 of tool 10, and as such no further detailed description will be given.

The tool 210 further comprises an initiator assembly 236 which is similar in form and function to the initiator assembly 36 of tool 10, and as such no further detailed description will be given.

The tool 210 further comprises a deflector arrangement 281. However, in this present embodiment the deflector arrangement 281 is defined by an annular face or shoulder 130 provided on a control assembly 280 which is mounted on the mandrel. The control assembly 280 is otherwise similar in form and function to the control assembly 80 of tool 10, and as such no further detailed description will be given, except to confirm that the control assembly 280 of tool 210 also comprises a releasable connection arrangement 290, similar to the releasable connection arrangement 90 of the tool 10.

Figure 9A:
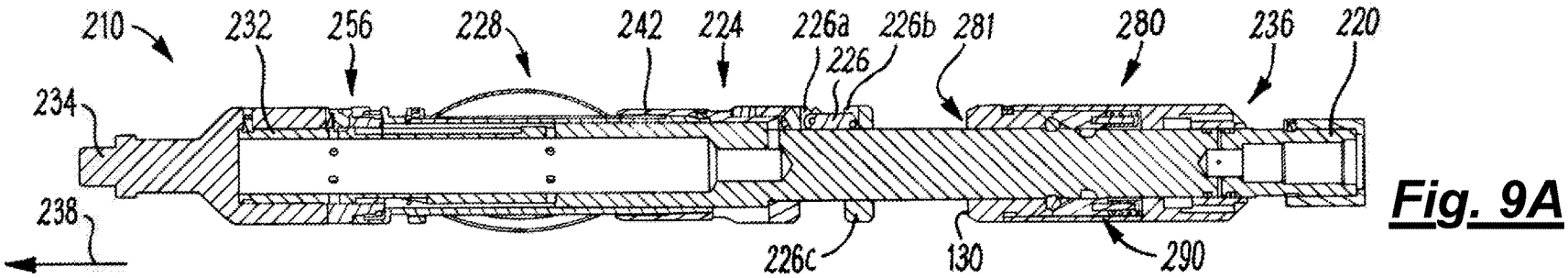
FIGS. 9A to 9C illustrate sequential stages of operation of a downhole initiator tool in accordance with an alternative embodiment of the present invention.
Figure 9B:
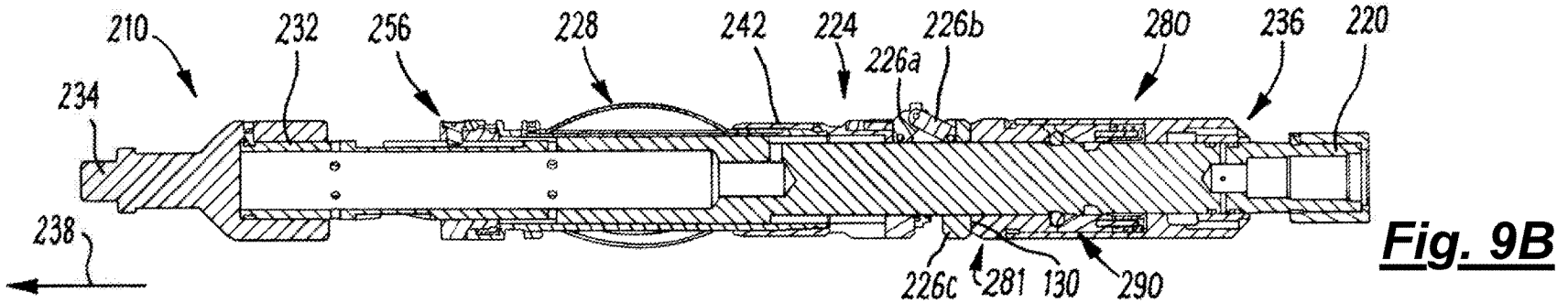

In use, the tool 210 may be deployed into a wellbore (not shown) in the initial configuration of FIG. 9A. Deployment may be achieved on wireline (also not shown) connected via connector 234, and the tool 210 may carry a downhole tool (also not shown) to be activated via connector 220. When initiation is required an upward pulling force may be applied on the mandrel 232 via connector 234 (for example by an upward pull on wireline) in the direction of arrow 238, wherein the anchor assembly 224 may be held substantially stationary relative to the wellbore by action of the preliminary anchor assembly 228 acting against the bore wall, permitting relative movement between the mandrel 232 and the anchor assembly 224 to be achieved. In a similar manner to tool 10 described above, a preliminary movement sequence may be required to be performed, controlled by the indexing arrangement 256, before the mandrel 232 and anchor assembly 224 can be sufficiently moved relative to each other to engage the toggle ring 226*c* against the shoulder 130 of the deflector arrangement 281, as illustrated in FIG. 9B. Continued relative movement between the mandrel 232 and the anchor assembly 224 may cause the toggle arrangements 226 to be activated and the anchor toggle portions 226*a* to be pivoted and radially extended to engage and grip an outer bore wall.

Figure 9C:
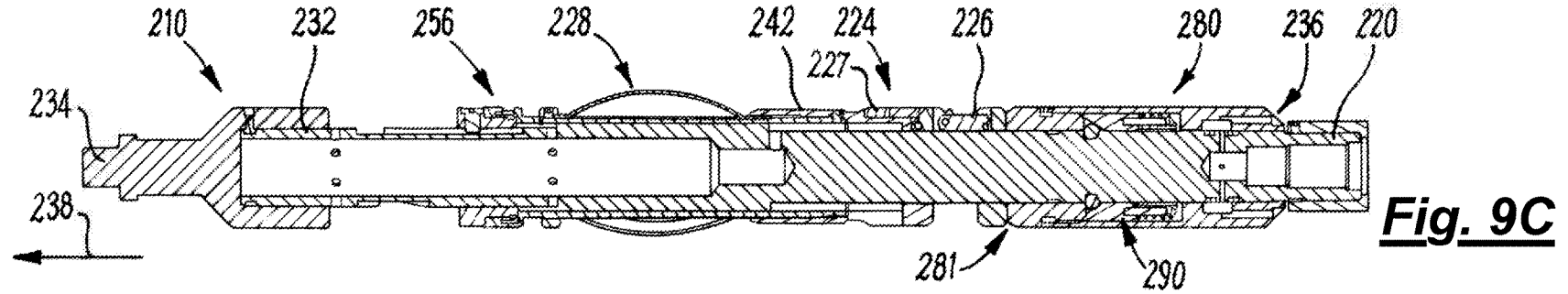

Once an anchor is established by the toggle arrangements 226, further axial force applied between the mandrel 232 and the anchor assembly 224 will cause the releasable connection 290 to become loaded, eventually releasing the connection between the control assembly 280 and the mandrel, and allowing the initiator assembly 236 to become activated, as shown in FIG. 9C. Also, following release of the connection between the control assembly 280 and the mandrel 232, the toggle arrangements 226 may be retracted again to remove any anchor. In a similar manner as in tool 10, respective biasing arrangements 227 act against each toggle arrangement 226 to assist in retraction.

An alternative embodiment of an initiator tool, identified by reference number 410, will now be described with reference to FIGS. 10A to 10C, which are sequential cross-sectional views of the tool 410 during operation. The tool 410 shares many similar features and functions in a very similar manner to the tool 10 first shown in FIG. 2, and as such like features share like reference numerals, incremented by 400. In view of the similarities between tool 410 and tool 10, only the principal differences will be highlighted.

In this case the tool 410 includes a mandrel 432 upon which is mounted an anchor assembly 424 which carries a number of anchor members 426. In this embodiment the anchor members 426 each comprise a dog radially mounted in a respective slot in a sleeve portion 442 of the anchor assembly 424.

The tool 410 further comprises a preliminary anchor assembly 428 which is similar in form and function to anchor assembly 28 of tool 10, and as such no further detailed description will be given.

The tool 410 further comprises an upper connector portion 434 for facilitating connection to wireline, for example, and a lower connector portion 420 for facilitating connection to, for example, a tool to be initiated or operated by the initiator tool 410.

The tool 410 further comprises an indexing arrangement or mechanism 456 which is similar in form and function to the indexing arrangement 56 of tool 10, and as such no further detailed description will be given.

The tool 410 further comprises an initiator assembly 436 which is similar in form and function to the initiator assembly 36 of tool 10, and as such no further detailed description will be given.

The tool 410 further comprises a deflector arrangement 481. However, in this present embodiment the deflector arrangement 481 is defined by an annular protrusion 132 integrally formed on an outer surface of the mandrel 432, wherein the annular protrusion comprises opposing ramp profiles 134, 136. As will be described in more detail below, the dogs 426 are radially extended when axially aligned with the annular protrusion 132.

The tool 410 further comprise a control assembly 480 which is mounted on the mandrel 432, wherein the control assembly 480 is similar in form and function to the control assembly 80 of tool 10, and as such no further detailed description will be given, except to indicate that the control assembly 480 comprises an annular shoulder 140, and to confirm that the control assembly 480 of tool 410 also comprises a releasable connection arrangement 490, similar to the releasable connection arrangement 90 of the tool 10.

Figure 10A:
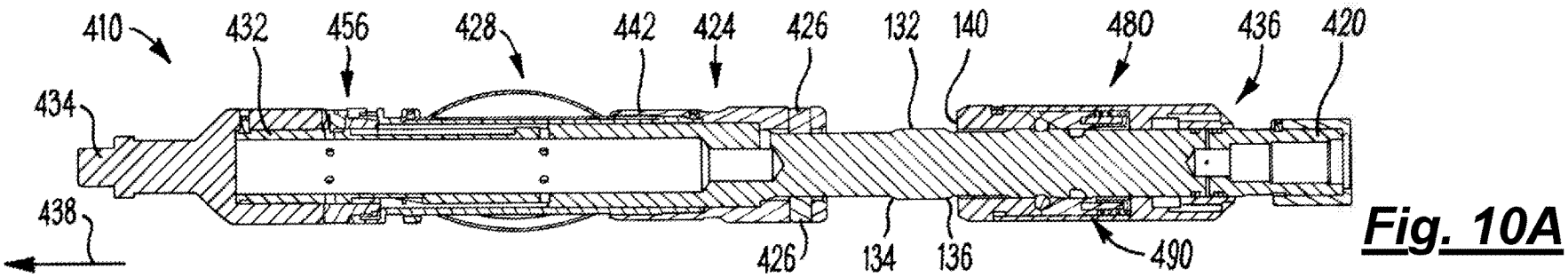
FIGS. 10A to 10C illustrate sequential stages of operation of a downhole initiator tool in accordance with a further alternative embodiment of the present invention.

In use, the tool 410 may be deployed into a wellbore (not shown) in the initial configuration of FIG. 10A. Deployment may be achieved on wireline (also not shown) connected via connector 434, and the tool 410 may carry a downhole tool (also not shown) to be activated via connector 420. When initiation is required an upward pulling force may be applied on the mandrel 432 via connector 434 (for example by an upward pull on wireline) in the direction of arrow 438, wherein the anchor assembly 424 may be held substantially stationary relative to the wellbore by action of the preliminary anchor assembly 428 acting against the bore wall, permitting relative movement between the mandrel 432 and the anchor assembly 424 to be achieved. In a similar manner to tool 10 described above, a preliminary movement sequence may be required to be performed, controlled by the indexing arrangement 456, before the mandrel 432 and anchor assembly 424 can be sufficiently moved relative to each other to align the dogs 426 with the annular protrusion 132, permitting the dogs 426 to radially extended, as shown in FIG. 10B. When extended the dogs 426 may grip an outer bore structure, such as a bore wall, and/or be received within a suitable profile.

Figure 10B:
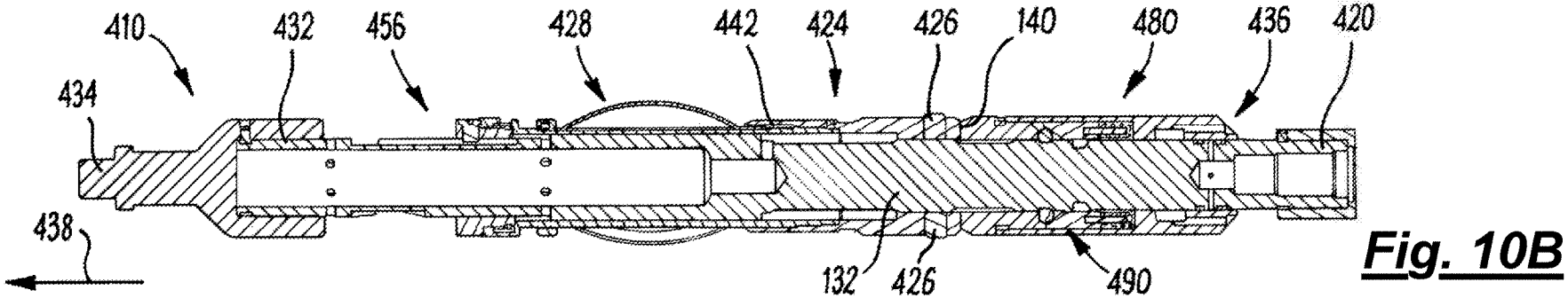

When in the configuration shown in FIG. 10B, an end of the sleeve 442 of the anchor assembly 424 abuts the annular shoulder 140 of the control assembly 480. When the releasable connection 490 is configured to provide a connection between the control assembly 480 and the mandrel 432, as in FIG. 10B, the control assembly 480 functions to limit relative movement between the anchor assembly 424 and the mandrel 432. Such a limit is provided at a location in which the dogs 426 are aligned with the annular protrusion 132 and thus extended.

Figure 10C:
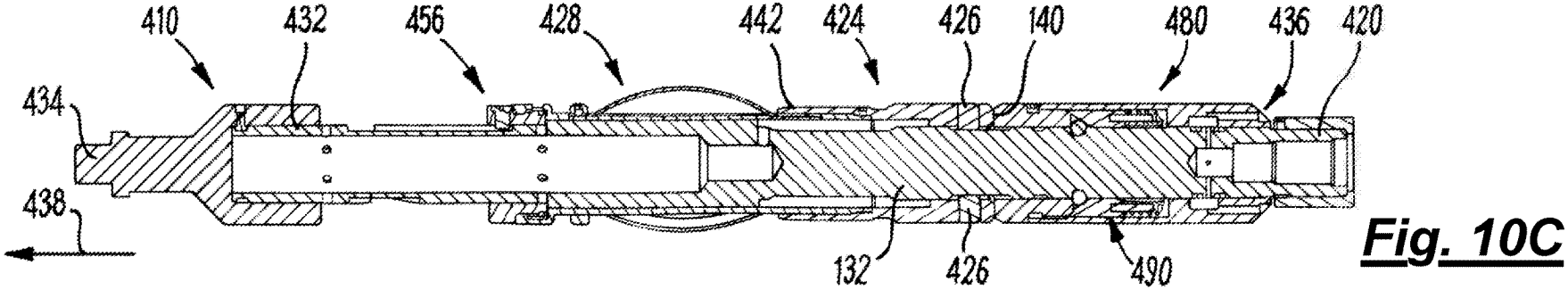

Once an anchor is established by the dogs 426, further axial force applied between the mandrel 432 and the anchor assembly 424 will cause the releasable connection 490 to become loaded, via the engagement between the sleeve 442 of the anchor assembly 424 and the annular shoulder 140 of the control assembly 480, eventually releasing the connection between the control assembly 480 and the mandrel 432, and allowing the initiator assembly 436 to become activated, as shown in FIG. 10C.

Following release of the connection between the control assembly 480 and the mandrel 432, the mandrel 432 may be free to move further in the same direction relative to the anchor assembly 424, causing misalignment between the dogs 426 and the annular protrusion 132, permitting the dogs 426 to be retracted, as shown in FIG. 10C.

A further alternative embodiment of an initiator tool, identified by reference number 610, will now be described with reference to FIGS. 11A to 11D, which are sequential cross-sectional views of the tool 610 during operation. The tool 610 shares many similar features and functions in a very similar manner to the tool 10 first shown in FIG. 2, and as such like features share like reference numerals, incremented by 600. In view of the similarities between tool 610 and tool 10, only the principal differences will be highlighted.

In this case the tool 610 includes a mandrel 632 upon which is mounted an anchor assembly 624 which carries a number of anchor members 626. In this embodiment the anchor members 626 each comprise a dog radially mounted in a respective slot in a sleeve portion 642 of the anchor assembly 624. Each dog 626 includes a profile 150 on a radially outwardly facing surface thereof.

The tool 610 further comprises a preliminary anchor assembly 628 which is similar in form and function to anchor assembly 28 of tool 10, and as such no further detailed description will be given.

The tool 610 further comprises an upper connector portion 634 for facilitating connection to wireline, for example, and a lower connector portion 620 for facilitating connection to, for example, a tool to be initiated or operated by the initiator tool 610.

The tool 610 further comprises an indexing arrangement or mechanism 656 which is similar in form and function to the indexing arrangement 56 of tool 10, and as such no further detailed description will be given.

The tool 610 further comprises an initiator assembly 636 which is similar in form and function to the initiator assembly 36 of tool 10, and as such no further detailed description will be given.

The tool 610 further comprises a deflector arrangement 681. However, in this present embodiment the deflector arrangement 681 is defined by a number of spring elements 152 mounted on an outer surface of the mandrel 632. As will be described in more detail below, each dog 626 is radially extended when axially aligned with a respective spring element 152.

The tool 610 further comprise a control assembly 680 which is mounted on the mandrel 632, wherein the control assembly 680 is similar in form and function to the control assembly 80 of tool 10, and as such no further detailed description will be given, except to indicate that the control assembly 680 comprises an annular shoulder 154, and to confirm that the control assembly 680 of tool 610 also comprises a releasable connection arrangement 690, similar to the releasable connection arrangement 90 of the tool 10.

Figure 11A:
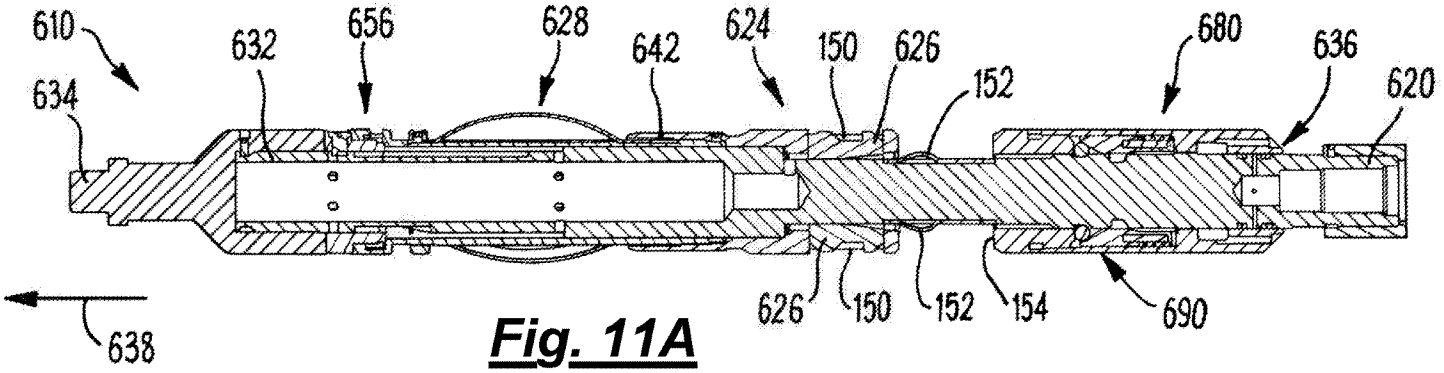
FIGS. 11A to 11D illustrate sequential stages of operation of a downhole initiator tool in accordance with another alternative embodiment of the present invention.

In use, the tool 610 may be deployed into a wellbore (not shown) in the initial configuration of FIG. 11A. Deployment may be achieved on wireline (also not shown) connected via connector 634, and the tool 610 may carry a downhole tool (also not shown) to be activated via connector 620. When initiation is required an upward pulling force may be applied on the mandrel 632 via connector 634 (for example by an upward pull on wireline) in the direction of arrow 638, wherein the anchor assembly 624 may be held substantially stationary relative to the wellbore by action of the preliminary anchor assembly 628 acting against the bore wall, permitting relative movement between the mandrel 632 and the anchor assembly 624 to be achieved. In a similar manner to tool 10 described above, a preliminary movement sequence may be required to be performed, controlled by the indexing arrangement 656, before the mandrel 632 and anchor assembly 624 can be sufficiently moved relative to each other to axially align the dogs 626 with the spring elements 152, permitting the dogs 626 to be radially extended, as shown in FIG. 11B.

Figure 11B:
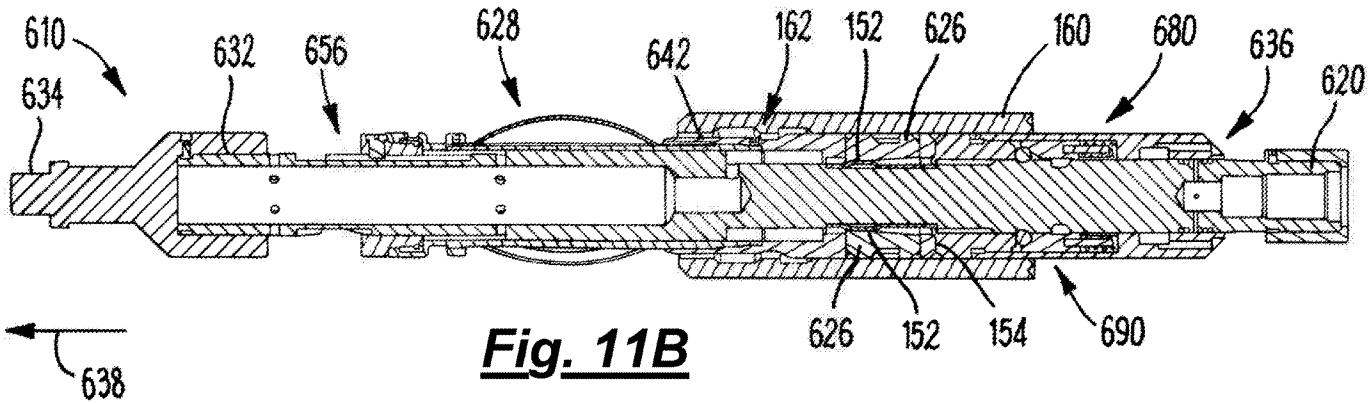
Figure 11C:
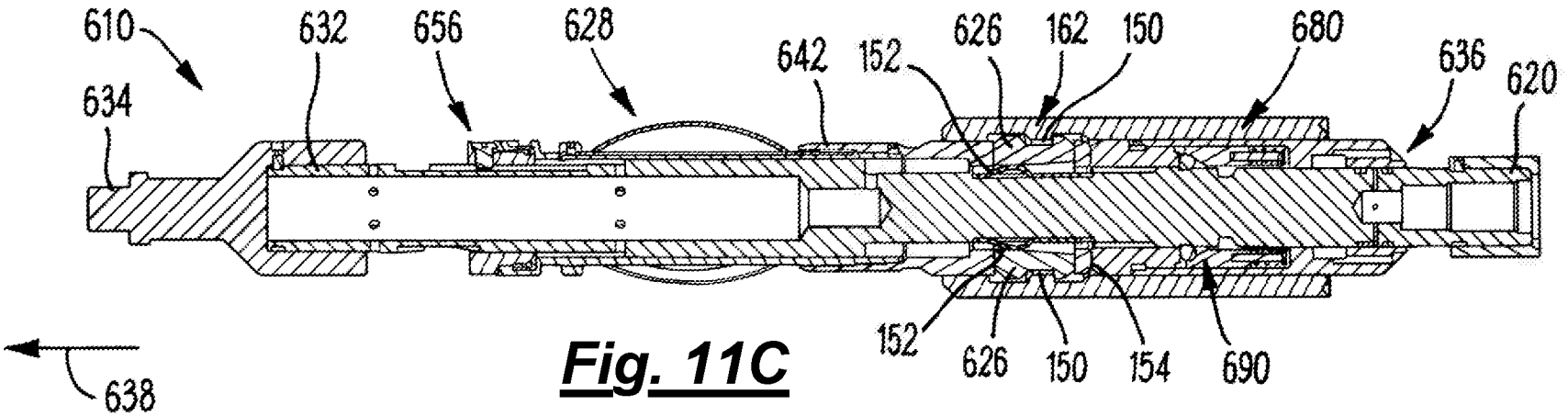

FIG. 11B illustrates the tool 610 positioned within an outer bore structure 160 (only a portion of the outer bore structure is illustrated) which includes a profile section 162. The profile section 162 compliments the profiles 150 of the dogs 626. As shown in FIG. 11B, the tool 610 is initially positioned relative to the outer bore structure 160 such that the dogs 626 are axially misaligned from the profile section 162 of the outer bore structure 160. In such a situation, the dogs 626 may not be fully extended and press against the radially outward bias of the spring elements 152. Movement of the entire tool 610 in the direction of arrow 638 will eventually align the dogs 626 with the profile section 162, as shown in FIG. 11C, permitting the dogs 626 to be radially extended by action of the spring elements 152, and allowing the profiles 150 of the dogs 626 to engage the complimentary profile section 162 and establish an anchor. Such an arrangement may allow the tool 610 to be set or anchored at a desired location, for example to ensure correct positioning of a further downhole tool to be initiated.

As the dogs 626 are extended on spring elements 152, the dogs may be radially compliant, and may be moved or deflected in a radial direction until such time as the profile section 162 is engaged. In some embodiments (not illustrated), a number of different profile sections may be provided in the outer bore structure 160, wherein the dogs 626 are configured only to match one of the profile sections. In such an arrangement as the tool 610 is moved relative to the outer bore structure 160 the dogs may simply be deflected by non-matching profiles until the matching profile is reached. This may provide a degree of downhole addressability, in that the ultimate location of the downhole initiator tool 610 may be selected in accordance with the type or form of dogs 626 utilised. In this respect, the dogs 626 may be readily interchangeably to utilise a number of different profiles 150.

When in the configuration shown in FIGS. 11B and 11C, an end of the sleeve 642 of the anchor assembly 624 abuts the annular shoulder 154 of the control assembly 680. When the releasable connection 690 is configured to provide a connection between the control assembly 680 and the mandrel 432, as in FIGS. 11B and 11C, the control assembly 680 functions to limit relative movement between the anchor assembly 624 and the mandrel 632. Such a limit is provided at a location in which the dogs 626 are axially aligned with the spring elements 152 and thus extended.

Figure 11D:
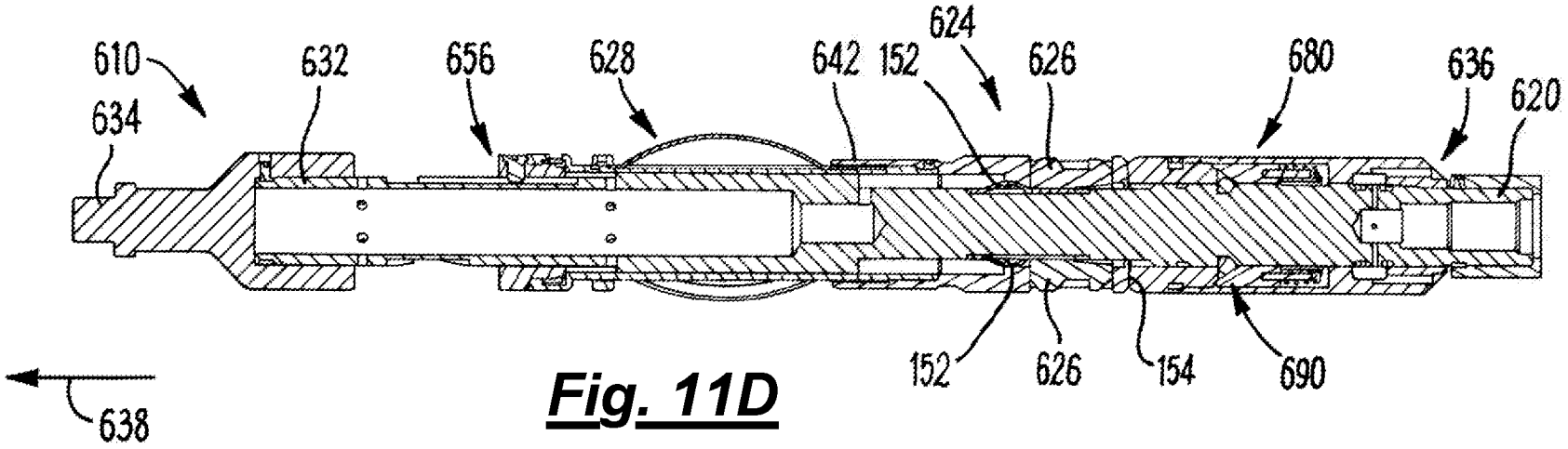

Once an anchor is established by the dogs 626, as shown in FIG. 11C, further axial force applied between the mandrel 632 and the anchor assembly 624 will cause the releasable connection 690 to become loaded, via the engagement between the sleeve 642 of the anchor assembly 624 and the annular shoulder 154 of the control assembly 680, eventually releasing the connection between the control assembly 680 and the mandrel 632, and allowing the initiator assembly 636 to become activated, as shown in FIG. 11D.

Following release of the connection between the control assembly 680 and the mandrel 632, the mandrel 632 may be free to move further in the same direction relative to the anchor assembly 624, causing misalignment between the dogs 626 and the spring elements 152, permitting the dogs 626 to be retracted, as shown in FIG. 100.

It should be understood that the embodiment described herein is merely exemplary and that various modifications may be made thereto without departing from the scope of the invention. For example, the releasable connection, such as connection 90 shown in FIG. 3, may be provided in isolation from other features in the illustrated embodiments, and may function to provide a latch assembly according to an embodiment of an aspect of the present invention. Also, the indexing arrangement, such as arrangement 56 illustrated in FIG. 3, may be provided in isolation form other features in the illustrated embodiments, and may function as an indexing apparatus according to an embodiment of an aspect of the present invention.

The invention provides a downhole initiator tool for use in initiating a downhole operation, and a method of use. The downhole initiator tool comprises a mandrel, an initiator assembly, and an anchor assembly mounted on the mandrel. The anchor assembly comprises a radially extendable anchor member for engaging an outer bore structure. The anchor assembly and the mandrel are axially moveable relative to each other in a first axial direction to sequentially extend the anchor member and activate the initiator assembly.

The invention extends to combinations of features other than those expressly claimed herein.

The invention claimed is:

1. A downhole initiator tool for use in actuating a downhole tool or system, comprising:

a mandrel;

an initiator assembly; and an anchor assembly mounted on the mandrel and comprising a radially extendable anchor member for engaging an outer bore structure, wherein the anchor assembly and the mandrel are axially moveable relative to each other in a first axial direction to sequentially extend the anchor member and activate the initiator assembly;

wherein the anchor assembly and the mandrel are axially moveable relative to each other in the first axial direction in a first relative movement action to cause the anchor member to be extended, and wherein the anchor assembly and the mandrel are axially moveable relative to each other in the same first axial direction in a second relative movement action to cause activation of the initiator assembly;

wherein the anchor member is retracted or permitted to be retracted during the second relative movement action.

2. The downhole initiator tool according to claim 1, wherein the creation of an anchor by the anchor member defines a limit or the end of a first movement action.

3. The downhole initiator tool according to claim 2, wherein the anchor assembly and the mandrel are axially moveable relative to each other in the first axial direction in a third relative movement action to cause the anchor member to be retracted.

4. The downhole initiator tool according to claim 2, wherein the anchor assembly and the mandrel are axially moveable relative to each other in a preliminary movement action prior to the first movement action.

5. The downhole initiator tool according to claim 1, wherein the anchor assembly and the mandrel are axially moveable relative to each other in the first axial direction to sequentially extend and retract the anchor member.

6. The downhole initiator tool according to claim 1, comprising an indexing arrangement provided between the mandrel and the anchor assembly.

7. The downhole initiator tool according to claim 6, wherein the indexing arrangement comprises a first indexing portion associated with one of the mandrel and the anchor assembly and comprising an indexing track, and a second indexing portion associated with the other of the mandrel and the anchor assembly and comprising a track follower to be received and move within the indexing track.

8. The downhole initiator tool according to claim 7, wherein one of the first and second indexing portions is rotatably fixed relative to one of the mandrel and the anchor assembly, and the other of the first and second indexing portions is rotatably mounted relative to the other of the mandrel and the anchor assembly.

9. The downhole initiator tool according to claim 1, wherein the downhole initiator tool comprises a provisional anchor assembly associated with the anchor assembly.

10. The downhole initiator tool according to claim 1, wherein the anchor member comprises a slip.

11. The downhole initiator tool according to claim 1, wherein the anchor member comprises a toggle arrangement comprising a toggle anchor portion configured to be pivoted to be radially extended and retracted.

12. The downhole initiator tool according to claim 1, wherein the anchor member comprises a dog arranged to be moved radially within the anchor assembly.

13. The downhole initiator tool according to claim 1, wherein the initiator assembly comprises a hydraulic initiator assembly.

14. The downhole initiator tool according to claim 1, wherein the initiator assembly comprises a valve or valve structure.

15. The downhole initiator tool according to claim 1, wherein the initiator assembly comprises at least first and second components which are caused to move relative to each other to activate the initiator assembly;

and wherein a first component is fixed relative to the mandrel, and a second component is fixed, at least temporarily, relative to the anchor assembly, such that relative movement between the anchor assembly and the mandrel provides relative movement between the first and second components of the initiator assembly.

16. The downhole initiator tool according to claim 15, configured such that one of the first and second components of the initiator assembly becomes fixed relative to the anchor assembly after the anchor member has been extended.

17. The downhole initiator tool according to claim 15, wherein the first and second components of the initiator assembly are moveable relative to each other to open a fluid port.

18. The downhole initiator tool according to claim 1, further comprising a control assembly mounted on the mandrel, wherein the control assembly is configured to permit, cause or facilitate the anchor member of the anchor assembly to be positioned in its extended position and/or is configured to permit, cause or facilitate the anchor member of the anchor assembly to be retracted from its extended configuration.

19. The downhole initiator tool according to claim 18, further comprising a releasable connection between the mandrel and the control assembly.

20. The downhole initiator tool according to claim 19, wherein the releasable connection comprises a latch member extending between the control assembly and the mandrel and moveable relative to the control assembly and the mandrel to selectively provide and release the connection therebetween.

21. The downhole initiator tool according to claim 1, wherein the mandrel comprises one or more ports which are initially sealed by a control assembly, and wherein relative movement between the mandrel and the control assembly permits the one or more ports in the mandrel to be opened.

22. The downhole initiator tool according to claim 1, wherein the initiator assembly is configured, when activated, to establish fluid communication between the fluid source and the downhole tool or system, to cause or facilitate actuation of the downhole tool or system.

23. The downhole initiator tool according to claim 1, wherein the initiator assembly, when activated, provides fluid/pressure communication between a wellbore environment and a downhole system, which permits hydrostatic pressure within the wellbore environment to be utilised to actuate the downhole system.

24. A method for downhole actuation of a downhole tool or system, the method comprising:

coupling an initiator tool to a downhole tool or system, wherein the initiator tool comprises a mandrel, an anchor assembly and an initiator assembly;

positioning the initiator tool in a wellbore;

establishing relative axial movement in a first axial direction between the anchor assembly and the mandrel to extend an anchor member of the anchor assembly into engagement with a bore structure; and establishing subsequent relative axial movement in the same first axial direction between the anchor assembly and the mandrel to cause activation of the initiator assembly to actuate the downhole tool or system, wherein activation of the initiator assembly establishes fluid communication between a fluid source and the downhole tool or system to thereby actuate the downhole tool or system.

25. The method according claim 24, comprising causing the anchor member of the anchor assembly to be retracted during or as a result of relative axial movement between the anchor assembly and the mandrel in the first axial direction.

* * * * *